US012064019B2

(12) United States Patent
Ni

(10) Patent No.: US 12,064,019 B2
(45) Date of Patent: Aug. 20, 2024

(54) HAIR DRYER

(71) Applicant: KINGCLEAN ELECTRIC CO., LTD., Jiangsu (CN)

(72) Inventor: Zugen Ni, Suzhou (CN)

(73) Assignee: KINGCLEAN ELECTRIC CO., LTD., Jiangsu (CN)

( * ) Notice: Subject to any disclaimer, the term of this patent is extended or adjusted under 35 U.S.C. 154(b) by 794 days.

(21) Appl. No.: 17/267,441

(22) PCT Filed: Dec. 19, 2019

(86) PCT No.: PCT/CN2019/126731
§ 371 (c)(1),
(2) Date: Feb. 9, 2021

(87) PCT Pub. No.: WO2020/186855
PCT Pub. Date: Sep. 24, 2020

(65) Prior Publication Data

US 2021/0321738 A1 Oct. 21, 2021

(30) Foreign Application Priority Data

Mar. 15, 2019 (CN) ..... 201910200054.5

(51) Int. Cl.
*A45D 20/12* (2006.01)

(52) U.S. Cl.
CPC ..... *A45D 20/12* (2013.01)

(58) Field of Classification Search
CPC ..... A45D 20/10; A45D 20/12; A45D 20/122
USPC ..... 392/380
See application file for complete search history.

(56) References Cited

U.S. PATENT DOCUMENTS

| | | | |
|---|---|---|---|
| 9,526,311 | B1 | 12/2016 | Schaefer et al. |
| 2007/0166208 | A1 | 7/2007 | Tanaka et al. |
| 2021/0298443 | A1 | 9/2021 | Ni et al. |
| 2021/0307476 | A1 | 10/2021 | Ni et al. |

FOREIGN PATENT DOCUMENTS

| | | | |
|---|---|---|---|
| CN | 201741682 U | | 2/2011 |
| CN | 106015050 A | | 10/2016 |
| CN | 106880155 A | | 10/2016 |
| CN | 205624987 | * | 10/2016 |
| CN | 205624987 U | | 10/2016 |

(Continued)

OTHER PUBLICATIONS

Japanese Office Action, Japanese Application No. 2021-517045 dated Apr. 5, 2022, 11 pages.

(Continued)

*Primary Examiner* — Dana Ross
*Assistant Examiner* — Joseph W Iskra
(74) *Attorney, Agent, or Firm* — Quarles & Brady LLP

(57) ABSTRACT

A hair dryer, relating to the technical field of home appliances. The hair dryer comprises an air blowing cylinder and a handle. An air blowing assembly and an electronic control PCB sleeved on the air blowing assembly are provided in the air blowing cylinder. The electronic control PCB is electrically connected to the air blowing assembly. The electronic control PCB is located outside a main air channel of the air blowing cylinder. The electronic control PCB is connected to a heat dissipation structure.

11 Claims, 19 Drawing Sheets

(56) References Cited

FOREIGN PATENT DOCUMENTS

| | | | | |
|---|---|---|---|---|
| CN | 205624987 | U | | 10/2016 |
| CN | 207532060 | U | | 6/2018 |
| CN | 108708339 | A | | 10/2018 |
| CN | 108903200 | A | | 11/2018 |
| CN | 109171160 | | * | 1/2019 |
| CN | 109171160 | A | | 1/2019 |
| CN | 109259408 | A | | 1/2019 |
| CN | 208524019 | U | | 2/2019 |
| CN | 109700159 | A | | 5/2019 |
| CN | 109743859 | A | | 5/2019 |
| CN | 109764002 | A | | 5/2019 |
| CN | 209671282 | U | | 11/2019 |
| CN | 209982903 | U | | 1/2020 |
| EP | 3831240 | A1 | | 6/2021 |
| JP | 01990034992 | A | | 2/1990 |
| JP | 01997224736 | A | | 9/1997 |
| JP | 2013236871 | | | 11/2013 |
| JP | 2015-066446 | A | | 4/2015 |
| JP | 2017-104554 | A | | 6/2017 |
| KR | 1020050108799 | A | | 11/2005 |

OTHER PUBLICATIONS

International Search Report and Written Opinion, International Application No. PCT/CN2019/126727, mailed on Feb. 6, 2020, 7 pages with English Translation.

International Search Report and Written Opinion, International Application No. PCT/CN2019/126728, mailed on Sep. 24, 2020, 8 pages with English Translation.

Office Action, on Korean Patent Application No. 10-2021-7012367, mailed on Nov. 21, 2022, 7 pages, English Translation, 8 pages.

Extended European Search Report, Application No. 19919742.7, dated Aug. 25, 2021, 7 pages.

International Search Report and Written Opinion, International Application No. PCT/CN2019/126731, mailed on Mar. 18, 2020, 7 pages, with English Translation.

* cited by examiner

HAIR DRYER

CROSS REFERENCE TO RELATED APPLICATION

This application is a 371 National Phase of PCT/CN2019/126731 filed Dec. 19, 2019, by Zugen N I entitled, "Hair Dryer" which claims priority to Chinese Patent Application No. CN 201910200054.5, entitled "Hair Drier with High Heat Dissipation Efficiency," filed on Mar. 15, 2019, the contents of which are expressly incorporated herein by reference in their entirety.

TECHNICAL FIELD

The present application relates to the technical field of household appliances, in particular, to a hair dryer.

BACKGROUND

Hair dryers are household appliances that are often used in daily life. In the hair dryer, fan blades are driven to rotate by a motor. When the fan blades rotate, air is sucked into a blower cylinder from an air inlet, passes through a heating assembly in the blower cylinder, and then forms a centrifugal airflow blown out of an air outlet at the front of the blower cylinder. The centrifugal airflow can be used to achieve the purposes of drying and styling of the hair dryer.

In the prior art, functional components (such as a blower and a control board) of the hair dryer are generally placed in the blower cylinder, and airflow passes through the functional components in the blower cylinder to ensure the heat dissipation effect to the functional components. However, such structure will cause a size of the blower cylinder to become larger. In addition, an electronic control printed circuit board (PCB) of a brushless motor when placed in an air passage will result in an increased noise and turbulence in inlet air.

Accordingly, a hair dryer is provided in the prior art, in which a brushless motor for driving fan blades and an electronic control PCB are placed into a handle, so that a blower cylinder with a smaller size may be obtained. Because of the volume of the brushless motor itself, the larger volume of the electronic control PCB used with the brushless motor and the volume of a shock absorbing sleeve of the brushless motor (for reducing the vibration of the handle of the hair dryer in use), the handle has a greater length and diameter, and thus user's feelings for gripping are poor.

In addition, the brushless motor and the electronic control PCB will generate a large amount of heat during an operating process. In order to prevent the handle from getting hot, air enters this type of hair dryer from an end of the handle thereof and enters the blower cylinder after passing through the handle, the hair dryer therefore having a longer air passage and a less air volume, which seriously affects an efficiency of the hair dryer.

Therefore, there is an urgent need for a hair dryer with a compact structure and a small size to solve the above problems.

SUMMARY

The present disclosure aims to provide a hair dryer, of which a blower cylinder is compact in structure and small in size.

To achieve such objects, the present disclosure adopts the following technical solutions.

A hair dryer includes a blower cylinder and a handle. The blower cylinder is provided with a blowing assembly and an electronic control printed circuit board (PCB) sleeved outside the blowing assembly therein. The electronic control PCB is electrically connected to the blowing assembly. The electronic control PCB is located outside a main air passage of the blower cylinder and is connected to a heat dissipation structure.

The discharging end is located on a central axis of the blower cylinder.

The discharging end extends toward an air outlet of the blower cylinder.

The blower cylinder has a length of less than 120 mm, and a diameter of less than 77 mm.

The handle has a length less than of 170 mm, and a diameter less than of 40 mm.

The hair dryer further includes a heating chamber disposed downstream of the blowing assembly. The blowing assembly is provided with a blowing chamber therein. The heating chamber and the blowing chamber forms the main air passage.

The heat dissipation structure includes:

an air director connecting the blowing assembly and the heating chamber. The air director is provided with a flow guiding structure thereon, and the flow guiding structure is configured to guide a portion of airflow passing through the blowing assembly to the electronic control PCB.

The blower cylinder is provided with a mounting sleeve therein. The electronic control PCB is sleeved outside the mounting sleeve. The blowing assembly includes a blower disposed in the mounting sleeve. An interior of the blower forms the blowing chamber.

The heat dissipation structure includes a heat dissipation assembly in contact with a heater element of the electronic control PCB. At least a portion of the heat dissipation assembly is located in the main air passage.

The heat dissipation assembly includes a first heat dissipation sheet. One end of the first heat dissipation sheet is in contact with the heater element of the electronic control PCB, and the other end of the first heat dissipation sheet is located in an air inlet of the blower cylinder.

The heat dissipation assembly includes a second heat dissipation sheet. One end of the second heat dissipation sheet is in contact with the heater element of the electronic control PCB, and the other end of the second heat dissipation sheet extends into the main air passage downstream of the blowing assembly.

A thermally conductive silicone grease is provided between the heater element and the heat dissipation assembly.

The handle is provided with a negative ion generator therein. A discharging end of the negative ion generator extends into the blower cylinder.

The blower cylinder is provided with an inner cylinder therein. The blower cylinder is provided with an ion outlet at the air-outlet-side thereof. The discharging end is located in the inner cylinder and disposed facing toward the ion outlet.

The handle is provided with a secondary air passage therein. The secondary air passage is in communication with the main air passage.

The handle is provided with a main control PCB therein, the heating chamber is provided with a heating assembly and a temperature detecting element therein. The main control PCB is electrically connected to the temperature detecting element. The heating assembly is electrically connected to the main control PCB. The main control PCB control the heating assembly to be turned on intermittently according to a temperature value obtained by the temperature detecting element.

The hair dryer further includes a nozzle. The nozzle is fixed to the blower cylinder by an attraction force.

The blower cylinder is provided with a magnet on an inner side of the air outlet. The nozzle is provided with an attracting block that cooperates with the magnet thereon.

The nozzle includes:

an air guiding member provided with an inlet in communication with the air outlet of the blower cylinder, an outlet, and an air channel providing a communication between the inlet and the outlet; and an adjusting member connected to the air guiding member, and capable of moving relative to the air guiding member, a size of a cross section at a certain position on the air channel can be adjusted when the adjusting member is moved relative to the air guiding member.

The nozzle includes a grille. The grille is configured to discharge a portion of air received by the nozzle in a first direction. The grille is extended to be provided with a plurality of comb teeth. At least a portion of the comb teeth are provided with a plurality of air outlet ports along a circumferential direction thereof. The air outlet ports are configured to discharge the other portion of the air in a second direction perpendicular to the first direction.

The blower cylinder is detachably connected to a protective cover at the air inlet. The protective cover is detachably provided with a filter assembly.

Advantageous effects: the present disclosure provides a hair dryer. In the hair dryer, the blowing assembly and the electronic control PCB are located in the blower cylinder. In order to reduce a space occupied by the blowing assembly and the electronic control PCB, the electronic control PCB is designed to have a ring shape, and is sleeved outside the blowing assembly, such that the blowing assembly and the electronic control PCB can be assembled more compactly, which reduces the space occupied by the blowing assembly and the electronic control PCB. Therefore, a size of the blower cylinder can be reduced through a reasonable layout of the components of the hair dryer, such that the size of the blower cylinder is the same as or even smaller than the size of the blower cylinder of a type of hair dryer in the prior art in which the blower is placed in the handle. In addition, on the basis that the blower cylinders in the present disclosure and in the prior art have the same size, compared to disposing the blowing assembly in the handle, the blowing assembly locating in the blower cylinder can reduce the length of the air passage, thereby improving the efficiency of the hair dryer. The electronic control PCB is connected to the heat dissipation structure, which can improve the heat dissipation effect of the electronic control PCB and solve the problem of poor heat dissipation of the PCB when the electronic control PCB is located outside the main air passage.

100—blower cylinder, 101—air inlet, 102—air outlet, 103—mounting opening,

11—housing, 111—protective cover, 1111—air inlet grille, 1112—latching block, 112—filter assembly, 1121—bracket, 1122—filter cloth, 1123—annular fixing hoop, 1124—first avoiding hole, 113—filter hood, 12—heating chamber, 121—outer cylinder, 1211—ion outlet, 122—inner cylinder, 123—heating assembly, 1231—heater element, 1232—heat insulation cylinder, 13—blowing assembly, 14—electronic control PCB, 15—air director, 16—magnet, 17—temperature detecting element, 18—mounting sleeve, 181—blower connecting portion, 182—end cover, 191—first heat dissipation sheet, 1911—base, 1912—fin, 1913—stepped surface, 192—second heat dissipation sheet;

200—handle;

21—case, 221—left case, 222—right case, 23—negative ion generator, 231—discharging end, 232—ion end cover, 24—main control PCB, 25—connecting member, 26—control button,

300—nozzle,

31—main body, 32—grille, 33—comb tooth, 331—air outlet port, 34—guiding fan, 35—air outlet portion, 351—inlet, 352—outlet, 353—force-bearing block, 36—adjusting member, 361—force applying block, 362—connecting protrusion, 363—guiding plate, 364—positioning block group, 37—connecting portion, 371—connecting hole, 372—guiding groove, 373—positioning protrusion;

400—power line.

DETAILED DESCRIPTION OF THE EMBODIMENTS

In order to make the solved technical problems, the adopted technical solutions, and achieved technical effects clearer, the technical solutions of the present disclosure will be further described below with reference to the drawings and the specific embodiments.

First Embodiment

Figure 1:
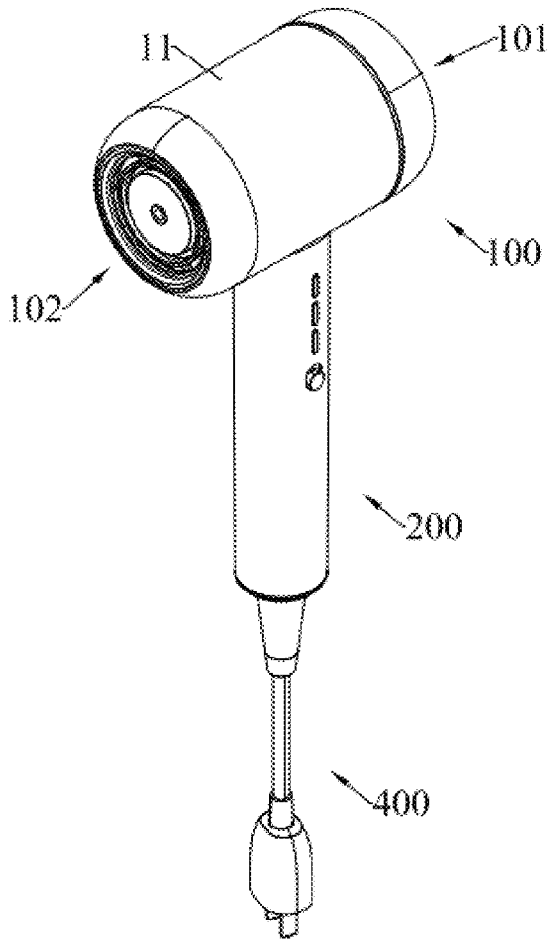
FIG. 1 is a schematic view of a hair dryer according to a first embodiment of the present disclosure.

As shown in FIG. 1, this embodiment provides a hair dryer, which includes a blower cylinder 100, a handle 200 connected to the blower cylinder 100, and a power line 400 connected to the handle 200. A main air passage is formed in the blower cylinder 100. A heating assembly 123 is disposed in the main air passage. The blower cylinder 100 is provided with an air inlet 101 and an air outlet 102 that are in communication with the main air passage. Airflow enters the main air passage via the air inlet 101 located at the rear side of the blower cylinder 100, and is discharged from the air outlet 102 after being heated by the heating assembly 123, thereby achieving the drying and styling functions of the hair dryer.

Figure 2:
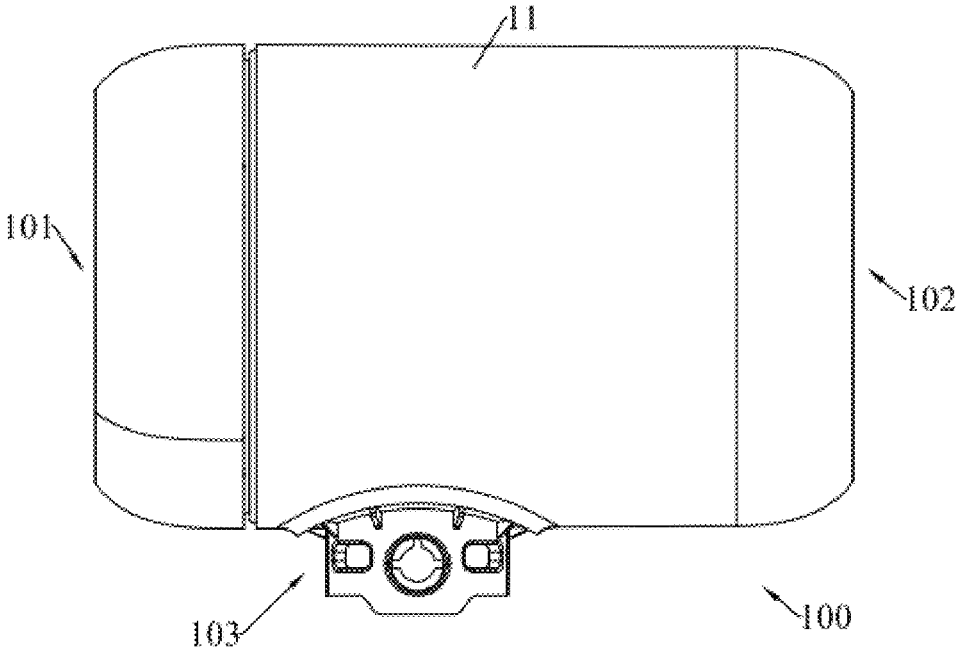
FIG. 2 is a schematic view of a blower cylinder according to the first embodiment of the present disclosure.

As shown in FIG. 2, the blower cylinder 100 includes a housing 11. Left and right ends of the housing 11 are opened for the airflow to enter and blow out. The housing 11 is provided with a mounting opening 103 at a bottom thereof. The handle 200 is connected to the blower cylinder 100 by the mounting opening 103.

Figure 3:
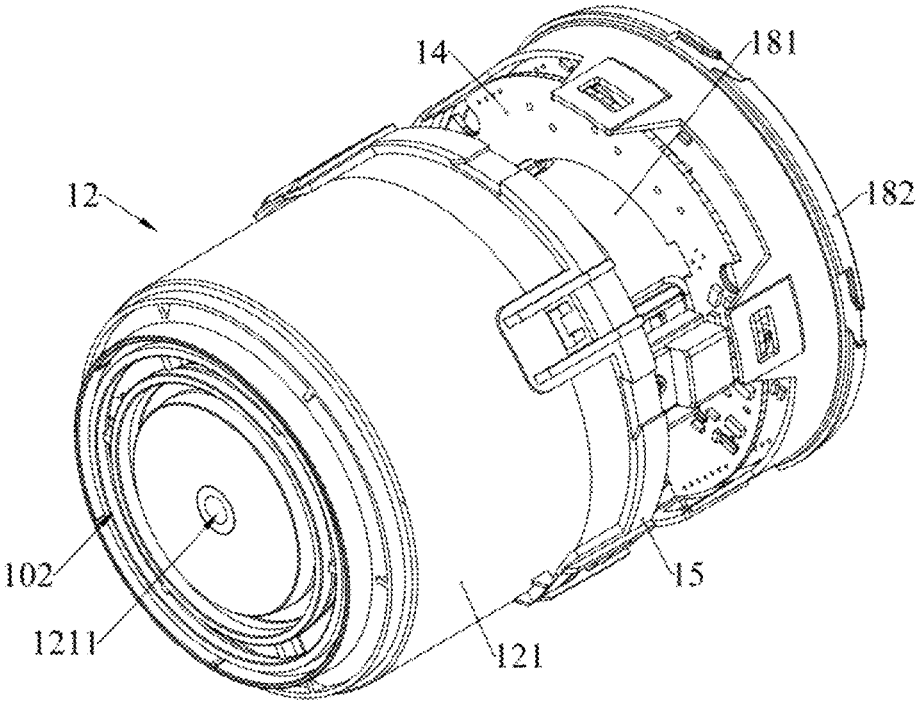
FIG. 3 is a first schematic view of the blower cylinder according to the first embodiment of the present disclosure, where a housing is removed.
Figure 4:
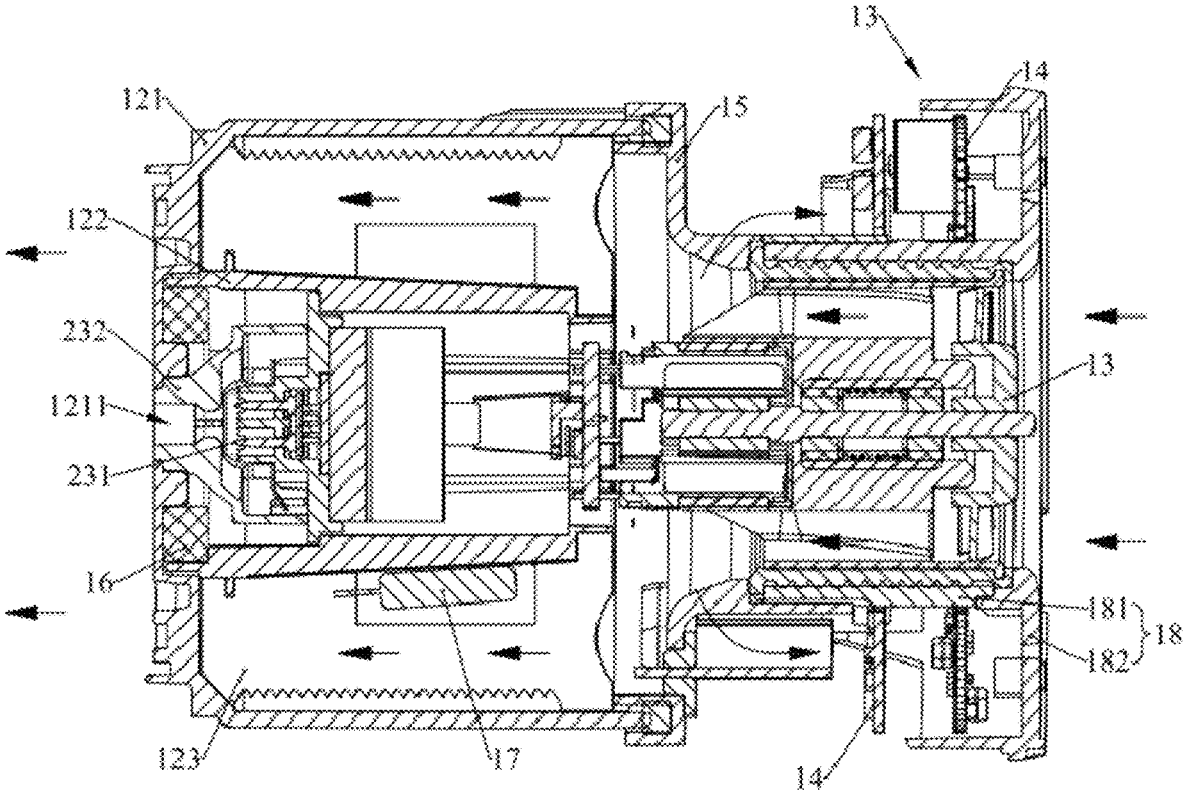
FIG. 4 is a first cross-sectional view of the blower cylinder according to the first embodiment of the present disclosure, where the housing is removed.

As shown in FIGS. 3 and 4, a heating chamber 12 is disposed at a position in the main air passage close to the air outlet 102. The heating assembly 123 is disposed in the heating chamber 12, and is used to heat the airflow in the main air passage. In this embodiment, the heating chamber 12 is disposed close to the air outlet 102, and the air heated by the heating assembly 123 is directly discharged from the blower cylinder 100, thereby reducing the loss of heat in the main air passage, and reducing energy consumption of the hair dryer under the premise that the outlet air temperature is ensured.

The hair dryer further includes a blowing assembly 13 for forming a negative pressure in the main air passage, such that the air outside the hair dryer can enter the main air passage under the action of negative pressure. As shown in FIG. 4, the blowing assembly 13 includes a blower and an electronic control PCB 14. The electronic control PCB 14 is connected to the blower for controlling start and stop of the blower, etc. The blower may include a motor and a fan. The motor drives the fan to rotate. Optionally, the motor may be a brushless motor.

In the prior art, in order to reduce a size of the blower cylinder 100, the blowing assembly 13 and the electronic control PCB 14 are disposed in the handle. Because of the volume of the brushless motor itself and the volume of the electronic control PCB used with the brushless motor are both larger, a length and a diameter of the handle are great, which is inconvenient for daily use or carrying, thereby affecting the user's use experience.

In order to solve the above problems, as shown in FIG. 4, in this embodiment, the blowing assembly 13 is disposed in the blower cylinder 100. The airflow sequentially passes through the blowing assembly 13 and the heating chamber 12 in the air passage. Optionally, the heating chamber 12 and the blowing assembly 13 may be in communication with each other through an air director 15. In this embodiment, the blowing assembly 13 is located in the blower cylinder 100 to reduce the size of the handle, so that the user has a better grip feeling to the handle and the hair dryer is convenient to be used and carried.

In order to solve a problem that the electronic control PCB 14 required to be used with the brushless motor occupies a large space, in this embodiment, the electronic control PCB 14 is configured to have a ring structure and be sleeved outside the blowing assembly 13. By providing the electronic control PCB 14 to have a ring shape, the space occupied by the electronic control PCB 14 can be reduced. The electronic control PCB 14 is sleeved outside the blowing assembly 13, such that the structure of the blower cylinder 100 can be more compact, which is beneficial to reduce the size of the blower cylinder 100. Optionally, the electronic control PCB 14 can be divided into two ring-shaped control boards, so that a radial size of a space of the blower cylinder 100 occupied by the electronic control PCB 14 can be reduced. The two ring-shaped control boards can be connected by connecting ribs. In this way, the blower cylinder 100 has a more compact structure.

Figure 5:
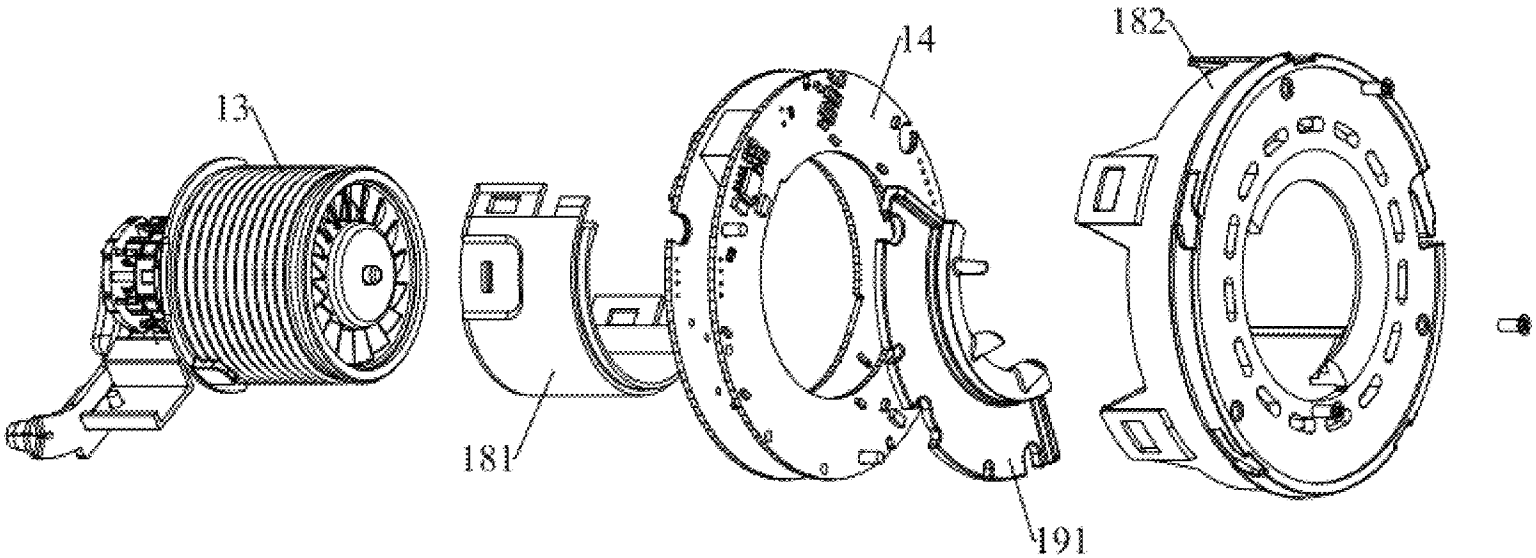
FIG. 5 is an exploded view showing a blowing assembly and an electronic control PCB according to the first embodiment of the present disclosure.

Specifically, as shown in FIGS. 4 and 5, the blowing assembly 13 includes the blower. A mounting sleeve 18 is disposed in the blower cylinder 100. The mounting sleeve 18 includes a cylindrical blower connecting portion 181 and an end cover 182 connected to an end of the blower connecting portion 181 close to the air inlet 101. Both ends of the mounting sleeve 18 are opened. The blower is located in the mounting sleeve 18, and thereby is protected. The ring-shaped electronic control PCB 14 is sleeved in the mounting sleeve 18, and therefore a direct contact between the blower and the electronic control PCB 14 can be avoided. The end cover 182 is disposed at an end of the mounting sleeve 18 close to the air inlet 101. The end cover 182 is provided with a central hole which is in communication with the air inlet 101 of the blower cylinder 100. An interior of the blower forms a blowing chamber in communication with the heating chamber 12, and thus, the blowing chamber and the heating chamber 12 together form the main air passage.

In this embodiment, the electronic control PCB 14 is sleeved outside the blowing assembly 13, that is, the electronic control PCB 14 is located outside the main air passage. The airflow is not in contact with the electronic control PCB 14, so that noise generated by the electronic control PCB 14 in the main air passage can be prevented, turbulence caused by disturbance of the airflow can be prevented, and smoothness of circulation of the airflow in the main air passage can be improved.

Since the electronic control PCB 14 is located outside the main air passage, and may generate a large amount of heat during operation, in order to facilitate the dissipation of the heat generated by the electronic control PCB 14 and avoid the heating of the blower cylinder 100, the electronic control PCB 14 is further connected to a heat dissipation structure. The heat dissipation structure can quickly dissipate the heat of the electronic control PCB, so that the heat dissipation problem of the electronic control PCB 14 disposed outside the main air passage can be solved.

Specifically, the heat dissipation structure includes a heat dissipation assembly. One end of the heat dissipation assembly is in contact with a heater element 1231 on the electronic control PCB 14, and the other end thereof extends into the main air passage to dissipate the heat generated by the heater element 1231. The heat dissipation assembly can be in direct contact with the heater element 1231, or be in indirect contact with the heater element 1231 via other structures, as long as these structures can conduct the heat.

The heat dissipation assembly is in contact with the heater element 1231, such that the heat generated by the heater element 1231 can be transferred to the heat dissipation assembly. At least a portion of the heat dissipation assembly is located in the main air passage, so that the heat of the heat dissipation assembly is taken away by airflow with a temperature lower than that of the heat dissipation assembly, such as natural wind, and thereby the heat generated by the heater element 1231 can be dissipated. That is, as an auxiliary heat dissipation device for the heater element 1231, the heat dissipation assembly can conduct away the heat generated by the heater element 1231 timely and efficiently, ensuring normal operations of structures such as the electronic control PCB 14, prolonging the service life of the product, and solving the problem that the electronic control PCB 14 cannot dissipate heat well in the conventional hair dryer.

Figure 6:
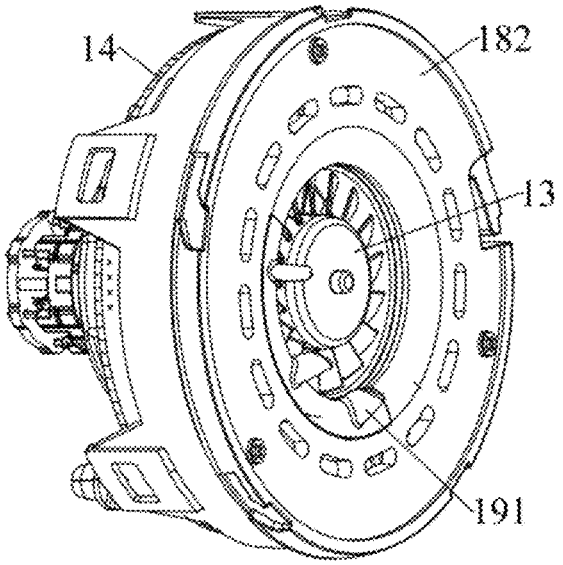
FIG. 6 is a schematic view showing the blowing assembly and the electronic control PCB after being assembled according to the first embodiment of the present disclosure.

Specifically, as shown in FIGS. 5 and 6, the mounting sleeve 18 may be further provided with a first heat dissipation sheet 191. One end of the first heat dissipation sheet 191 is in contact with the heater element 1231 on the electronic control PCB 14, and the other end thereof is located in the air inlet 101 of the blower cylinder 100. The heat generated by the heater element 1231 will be transferred to the first heat dissipation sheet 191 by thermal conduction, transferred to the end of the first heat dissipation sheet 191 located in the air inlet 101 through the first heat dissipation sheet 191, and taken away by airflow entering the air inlet 101. In this embodiment, the airflow that takes away the heat will pass through the blowing chamber and enter the heating chamber 12 where the heat generated by the heater element 1231 is used, which avoids waste of the heat. Optionally, the heater element 1231 in this embodiment may be a metal oxide semiconductor (MOS) transistor or a silicon-controlled rectifier on the electronic control PCB 14.

Figure 7:
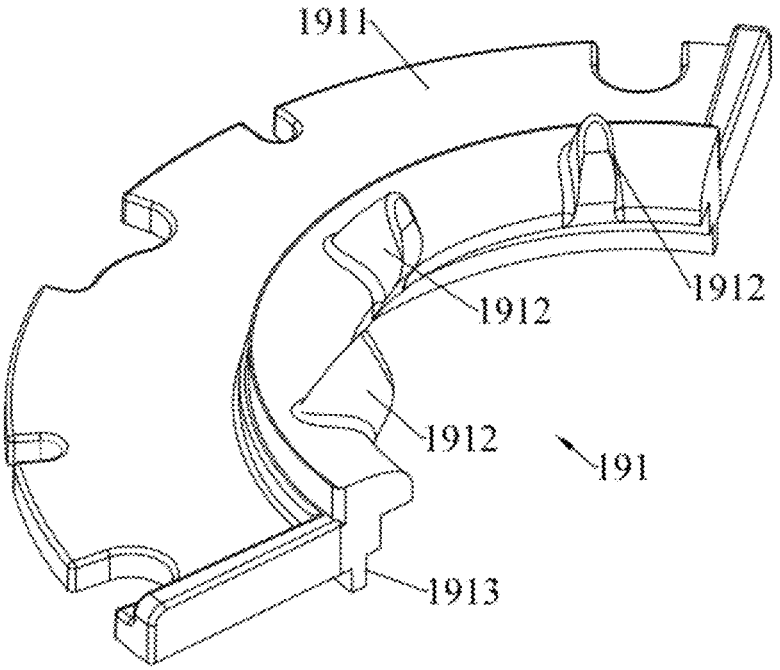
FIG. 7 is a schematic view of a first heat dissipation sheet according to the first embodiment of the present disclosure.

As shown in FIG. 7, the first heat dissipation sheet 191 includes a base 1911 and a plurality of fins 1912 disposed on the base 1911. The fins 1912 are disposed extending from the heater element 1231 toward the air inlet end. Preferably, the fins 1912 are disposed obliquely toward the direction of the incoming air, so that an airflow resistance and noise are reduced as much as possible while the heat exchange area between the fins 1912 and the airflow is increased. That is, the extending direction of the fins 1912 is opposite to a direction of an inletting air of the hair dryer, such that the fins 1912 can be in contact with the airflow located further upstream and having a lower temperature.

Each of the fins 1912 includes a bottom away from the air inlet end, a top close to the air inlet end, a front side surface on a windward side, and a rear side surface on a leeward side. The fin 1912 is disposed on the base 1911 by the bottom thereof, such that the fins are more stable. The top is necessarily positioned in the main air passage, and whether other structures are positioned in the main air passage or not is determined according to actual usage requirements. In this embodiment, the top of the fin 1912 is located in the air inlet 101.

Along the direction of the inletting air, a distance between the top and the bottom gradually decreases. That is, the top is a slope inclined along the direction of the inletting air, so that the airflow resistance and noise may be reduced without affecting the heat dissipation. The front side surface is an externally convex arched shape, that is, similar to a corrugated shape, so that the airflow is more smooth and stable and the noise is low when the inletting air blows over the front side surface. A connection portion between the rear side surface and the top is an arc surface. That is, the rear side surface and the top are smoothly and transitionally connected with each other, which prevent the inletting air from being blocked at the connection portion between the rear side surface and the top.

The base 1911 is provided with a stepped surface 1913. The stepped surface 1913 is attached to the heater element 1231, and thus the thermal conduction efficiency is high. In addition, the stepped surface 1913 can also play a role of mutual limiting between the base 1911 and the heater element 1231.

The specific shape of the base 1911 is not limited, as long as it can efficiently conduct heat for the heater element 1231. Preferably, the base 1911 is a sector-shaped structure aligned with a heating point on the heater element 1231 or a ring-shaped sheet structure aligned with the heater element 1231 as a whole. When the base 1911 is ring-shaped, the heat dissipation area is large and the heat dissipation efficiency is high. When the base 1911 has is sector-shaped, it is small in volume and light in weight, which is beneficial to miniaturization and lightening of the hair dryer. Preferably, the base 1911 is directly thermally connected to the heating point on the heater element 1231, and thus the thermal conduction efficiency is higher.

The base 1911 not only can conduct heat at a portion attached to the heater element 1231, but also can quickly conduct away the heat in a space around the heater element 1231 at a portion not attached to the heater element 1231, which also has the function of assisting the heater element 1231 in heat dissipation.

Optionally, in this embodiment, the electronic control PCB 14 has a double-layer ring-shaped structure. Electrical elements on the electronic control PCB 14 may be disposed on two outer ring-shaped surfaces of the double-layer ring-shaped structure. The electrical elements on one side close to the air inlet 101 can dissipate heat by the above first heat dissipation sheet 191. The heat dissipation assembly connected to the other side is difficult to extend into the air inlet 101 due to the other side being away from the air inlet 101, so that the heat dissipation effect of the electrical elements on the other side is poor.

Figure 8:
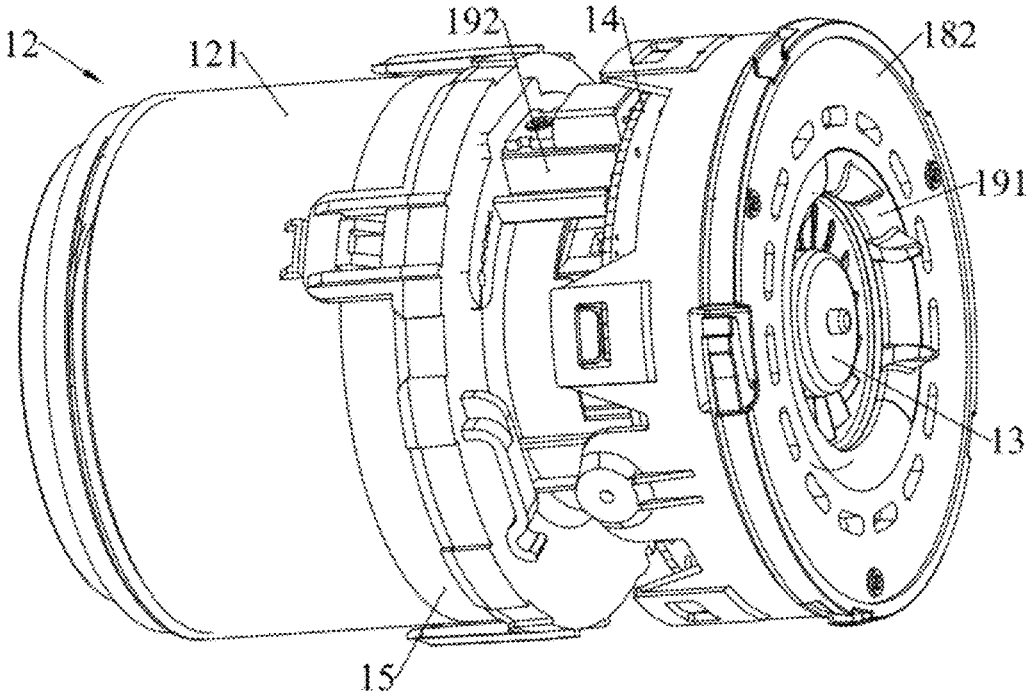
FIG. 8 is a second schematic view of the blower cylinder according to the first embodiment of the present disclosure, where a housing is removed.
Figure 9:
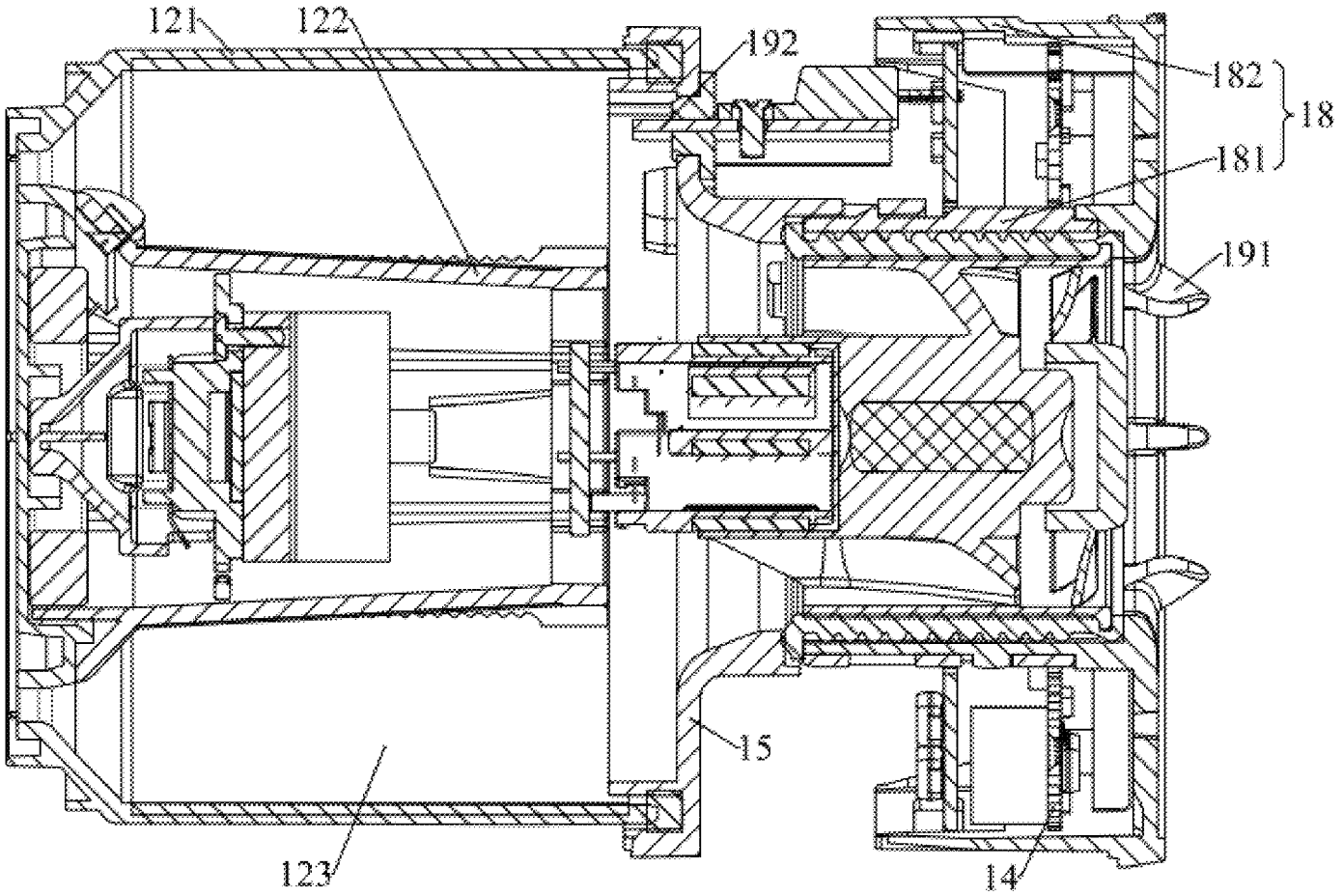
FIG. 9 is a second cross-sectional view of the blower cylinder according to the first embodiment of the present disclosure, where the housing is removed.

To solve the above problem, in this embodiment, as shown in FIGS. 8 and 9, the heat dissipation assembly further includes a second heat dissipation sheet 192. The second heat dissipation sheet 192 is located on a side of the electronic control PCB 14 away from the air inlet. One end of the second heat dissipation sheet 192 is in contact with the heater element 1231 of the electronic control PCB 14, and the other end thereof can extend into the heating chamber 12, so that heat is taken away by the airflow entering the heating chamber 12, thereby achieving heat dissipation. Specifically, the second heat dissipation sheet 192 can pass through the air director 15 and extend into the upstream of the heating chamber 12, that is, into the air director 15. The temperature of the air at the upstream of the heating chamber 12 is lower, so that the heat dissipation efficiency can be improved. Moreover, the heat generated by the second heat dissipation sheet 192 can be used to heat the airflow, which may improve the heat utilization rate.

In order to reduce a gap between the second heat dissipation sheet 192 and the air director 15, an air blocking plug is further provided between the second heat dissipation sheet 192 and the air director 15. The air blocking plug can prevent the air in the heating chamber 12 from entering a space between the housing 11 and the main air passage.

On the basis of the above structure, a clearance between the heat dissipation assembly and the heater element 1231 is filled with a thermally conductive material, such that the heat dissipation assembly and the heater element 1231 are reliably thermally connected to each other, thereby avoiding that the heat generated by the heater element 1231 cannot be transferred to the heat dissipation assembly due to the isolation of air. The thermally conductive material can be, but is not limited to, thermally conductive silicone grease, as long as it can ensure an efficient heat transfer.

In other embodiments, the heat dissipation structure may also be the air director 15. Specifically, the air director 15 connecting the blowing assembly 13 and the heating chamber 12 may be provided with a flow guiding structure. The flow guiding structure may guide a portion of the airflow coming from the air inlet 101 to the electronic control PCB 14 to improve the heat dissipation effect to the electronic control PCB 14. Specifically, the air director 15 has one end connected to the mounting sleeve 18 of the blowing assembly 13, and the other end connected to the heating chamber 12. The air director 15 is provided with a first shunting hole. The end cover 182 of the blowing assembly 13 is provided with a second shunting hole. A portion of the airflow passing through the air director 15 enters a space between the housing 11 and the blowing assembly 13 through the first shunting hole, to cool the electronic control PCB 14. The airflow that absorbs the heat of the electronic control PCB 14 flows out from the second shunting hole, thereby forming a circulating air path for cooling the electronic control PCB 14.

In order to prevent the hair, after dried by using the hair dryer, from generating static electricity, the hair dryer can further include a negative ion generator 23. The negative ion generator 23 can generate negative air ions. The negative air ions will be in contact with the hair with flowing of the airflow to prevent the hair from generating static electricity, thereby making the hair suppler, and achieving the purpose of hair maintenance. However, in the conventional hair dryer, the negative ion generator 23 is located in the blower cylinder 100, for example, on an outer peripheral surface of the heating chamber 12, and thus occupies the inner space of the blower cylinder 100, such that a gap between the heating chamber 12 and the housing 11 is larger, resulting in a larger size of the blower cylinder 100.

Figure 10:
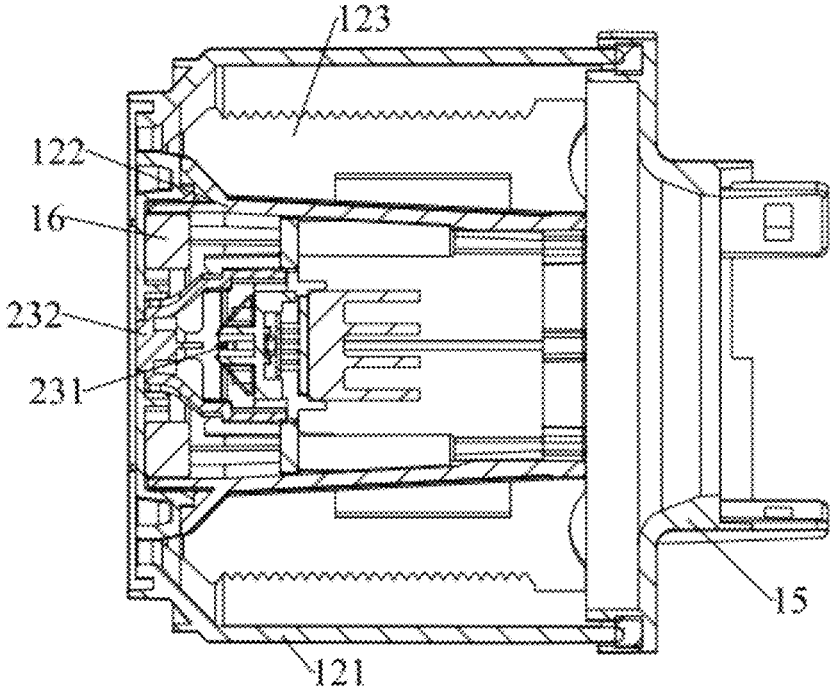
FIG. 10 is a cross-sectional view of a heating chamber according to the first embodiment of the present disclosure.
Figure 11:
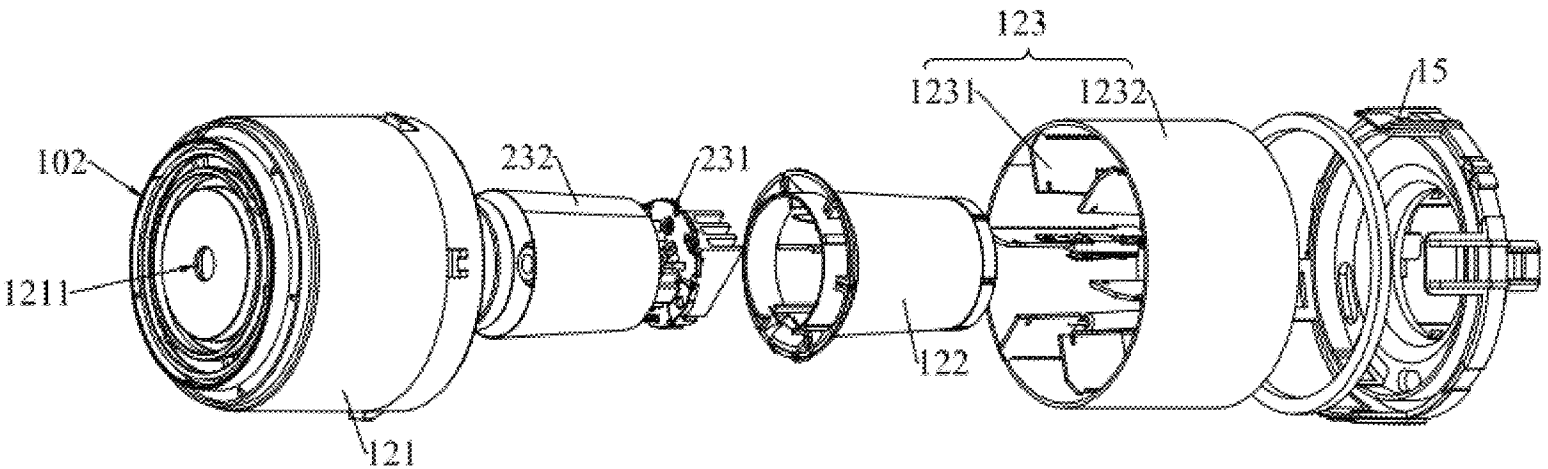
FIG. 11 is an exploded view of the heating chamber according to the first embodiment of the present disclosure.
Figure 12:
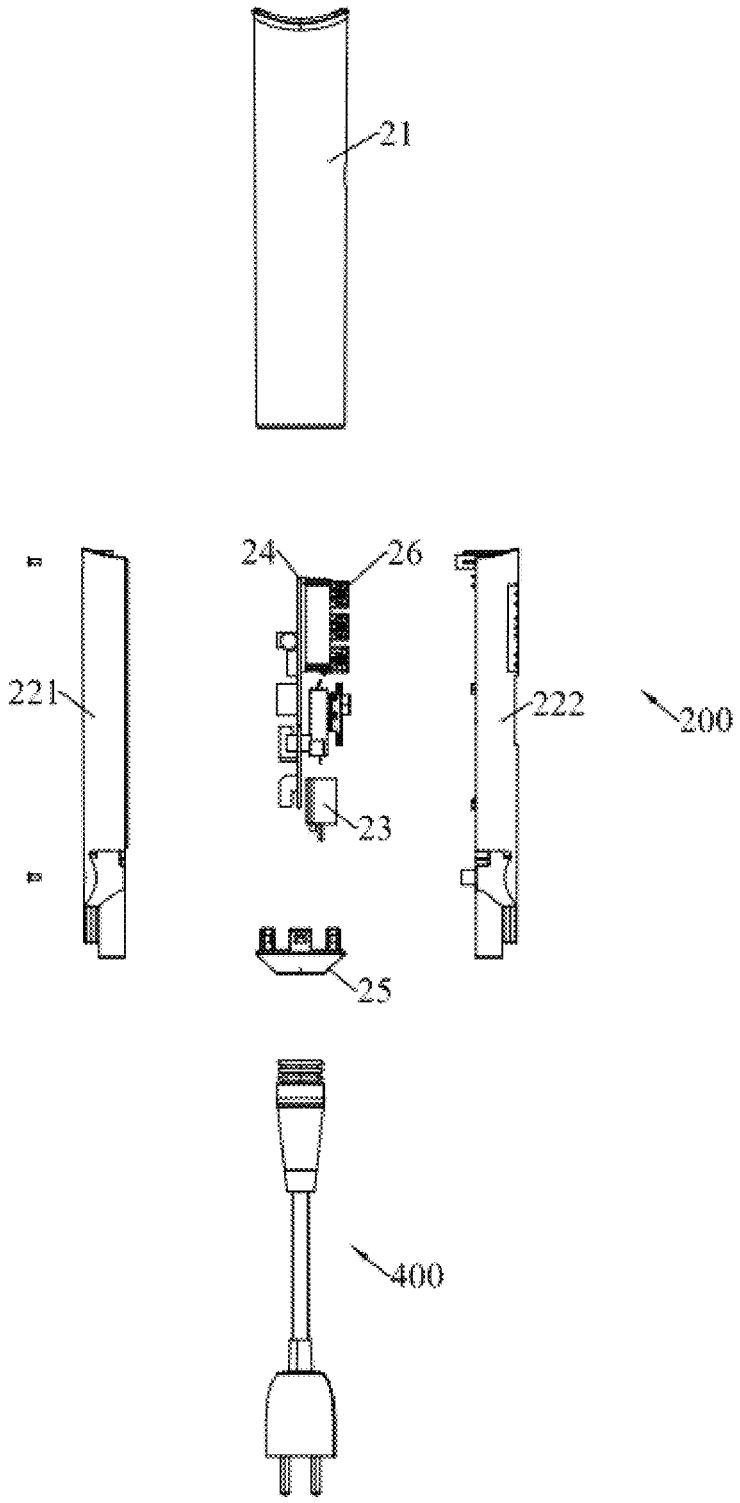
FIG. 12 is an exploded view of a handle according to the first embodiment of the present disclosure.

In order to solve the above problem, in this embodiment, as shown in FIGS. 10 to 12, the negative ion generator 23 is disposed in the handle 200. A discharging end 231 of the negative ion generator 23 extends into the blower cylinder 100. By disposing the negative ion generator 23 in the handle 200, a size of the blower cylinder 100 is reduced and the distance between the heating chamber 12 and the housing 11 is also reduced. Thus, the blower cylinder 100 has a more compact structure, which is beneficial to reduce the size of the blower cylinder 100.

Considering a short time for the negative ions to exist in the air, the discharging end 231 may be configured to extend to the air outlet 102 of the blower cylinder 100 to short the time for the negative ions generated by the discharging end 231 to stay in the main air passage, and thus make the negative ions contact the hair as soon as possible.

Optionally, the discharging end 231 may be located on a central axis of the blower cylinder 100. On the one hand, the space utilization rate in the blower cylinder 100 can be further improved, and on the other hand, the negative ions can be more uniformly distributed in the blower cylinder 100.

Specifically, the heating chamber 12 includes an outer cylinder 121 and an inner cylinder 122. A downstream end of the outer cylinder 121 is provided with an ion outlet 1211 and the air outlet 102. The inner cylinder 122 is opened at both ends, and is disposed in the outer cylinder 121. The heating assembly 123 is disposed between the inner cylinder 122 and the outer cylinder 121. The discharging end 231 is located in the inner cylinder 122 and is disposed facing toward the ion outlet 1211. The airflow enters the space between the inner cylinder 122 and the outer cylinder 121 after passing through the blowing chamber. While the airflow is heated up by the heating assembly 123, the discharging end 231 works to generate negative ions. The negative ions are discharged from the ion outlet 1211 and then mixed into the airflow, and are in contact with the hair, so as to eliminate the static electricity of the hair.

In order to protect the discharging end 231, an ion end cover 232 is further disposed outside the discharging end 231 to prevent components in the heating chamber 12 from contacting the discharging end 231, and thus the discharging end 231 is protected.

Optionally, the heating assembly 123 includes a plurality of heating units. Each heating unit extends along an axial direction of the inner cylinder 122. The plurality of heating units are uniformly distributed along a circumferential direction of the inner cylinder 122, thereby improving the uniformity of heating. In order to prevent heat from being dissipated through the outer cylinder 121, the heating assembly 123 further includes a heat insulation cylinder 1232 disposed inside the outer cylinder 121. The heat insulation cylinder 1232 can reduce heat loss and improve heat utilization rate.

As shown in FIG. 12, in order to facilitate the user to use the hair dryer, the handle 200 is further provided with control buttons 26 such as a switch button, an air speed adjusting button, an air temperature adjusting button, a mode switching button and the like, so as to control the start and stop, air speed, air temperature of the hair dryer or to choose an appropriate blowing mode. In order to control the hair dryer by the above buttons, a main control PCB 24 is further provided in the handle 200. The main control PCB 24 is connected to the blowing assembly 13, the heating assembly 123, and the negative ion generator 23, respectively, so as to control the blowing assembly 13 and the heating assembly 123 according to the operation of the user. Optionally, the negative ion generator 23 can be disposed at a bottom of the main control PCB 24.

Optionally, the hair dryer may further include a plurality of nozzles. Each nozzle is detachably connected to the air outlet 102 of the blower cylinder 100, such that the nozzle can be replaced according to different requirements of users. Optionally, the nozzle can be connected to the blower cylinder 100 via a snapping structure, fixed to the blower cylinder 100 by an attraction force of a magnetic member, or connected to the blower cylinder 100 via a fastener such as a screw.

In a hair dryer of the prior art, a blower is placed in the handle 200 to reduce the size of the blower cylinder 100, such as a Dyson Supersonic HD01 hair dryer. Its blower cylinder 100 has a diameter and length of 78 mm and 97 mm, respectively, but the handle 200 has been lengthened and has a length of 245 mm. In this embodiment, by adjusting the structures and positions of the components in the hair dryer, the size of the blower cylinder 100 can be reduced. In an embodiment of the present disclosure, the length of the blower cylinder 100 does not exceed 125 mm, for example, is less than 120 mm; the diameter of the blower cylinder 100 does not exceed 80 mm, for example, is less than 77 mm. It can be seen that a difference between the size of the blower cylinder 100 of the present disclosure and the size of the blower cylinder 100 of the Dyson Supersonic HD01 hair dryer is small, but the main air passage of the blower cylinder 100 of the present disclosure does not pass through the handle 200, thereby greatly shortening the length of the main air passage, and improving the efficiency of the hair dryer. By reasonably arranging the components in the blower cylinder 100, the volume of the handle 200 does not need to be increased. For example, the handle 200 may have the length not exceeding 125 mm and the diameter not exceeding 40 mm. In another example, the handle 200 may have the length shortened to 170 mm and the diameter reduced to 38 mm. Comparing to the handle 200 with the length of 245 mm in the prior art, the length of the handle 200 of the present disclosure is greatly shortened.

Second Embodiment

This embodiment provides a hair dryer. The hair dryer in the second embodiment differs from the hair dryer in the first embodiment in that a protective device is further provided in the hair dryer to prevent the hair dryer from overheating. The protective device includes a temperature detecting element 17. As shown in FIG. 4, the temperature detecting element 17 may be disposed in the heating chamber 12. Specifically, the temperature detecting element 17 is disposed on an outer peripheral surface of the inner cylinder 122. The main control PCB 24 receives a signal from the temperature detecting element 17, and controls the heating assembly 123 to stop intermittently according to a temperature value obtained by the temperature detecting element 17.

Specifically, the main control PCB 24 includes a storage unit, a comparison unit, and an execution unit. The storage unit is used to pre-store a first temperature preset value and a second temperature preset value. The comparison unit is used to compare the temperature value obtained by the temperature detecting element 17 with the first temperature preset value and the second temperature preset value. The execution unit is configured to determine that the hair dryer, when working in a drying mode, is overheated if the temperature value obtained by the temperature detecting element 17 is higher than the first temperature preset value. The main control PCB 24 controls the heating assembly 123 to be turned off and stop heating, and the blowing assembly 13 of the hair dryer is normally worked. When the hair dryer is operating in a drying mode and the heating assembly 123 is in a stopped state, if the temperature value obtained by the temperature detecting element 17 is lower than the second temperature preset value, the main control PCB 24 controls the heating assembly 123 to be turned on again.

When the temperature value obtained by the temperature detecting element 17 is between the second temperature preset value and the first temperature preset value, a temperature of the heating assembly 123 is determined to be normal. Herein, the first temperature preset value and the second temperature preset value are not limited, and can be set according to actual conditions.

When the hair dryer is used in the drying mode, the blowing assembly 13 and the heating assembly 123 are started at the same time to provide hot air. During the use, the temperature detecting element 17 will detect a temperature of the heating assembly 123 in real time, and transmit the obtained temperature signal to the main control PCB 24. The main control PCB 24 obtains a current temperature value of the heating assembly 123 and compares it with the first temperature preset value and the second temperature preset value. If the current temperature value is between the second temperature preset value and the first temperature preset value, the temperature of the heating assembly 123 is determined to be normal.

After the hair dryer is used for a period of time, if the temperature value of the heating assembly 123 is higher than the first temperature preset value, the heating assembly 123 is determined to be overheated. The heating assembly 123 will be turned off and stop heating by the control of the main control PCB 24 to prevent the components of the hair dryer from being burnt or users from being scalded due to an excess temperature of the hair dryer. At this time, the blowing assembly 13 still operates normally, and the heating assembly 123 having residual heat can also be ensured to generate hot air. In this case, the blowing assembly 13 can still blow airflow to cool down the heating assembly 123, and during the time that the heating assembly 123 stops heating, the heating assembly 123 can also be ensured to generate hot air by its residual heat, which does not affect normal use of the hair dryer. When the temperature of the heating assembly 123 is lowered to be lower than the second temperature preset value, the main control PCB 24 controls the heating assembly 123 to work again. The intermittent work of the heating assembly 123 is beneficial to cooling down the heating assembly 123 and does not affect normal use of the hair dryer.

The main control PCB 24 is connected to the heating assembly 123 via a heating regulation and control circuit. The heating control circuit is provided with a silicon-controlled rectifier thereon. The main control PCB 24 controls the silicon-controlled rectifier to work and stop. When the silicon controlled rectifier is turned off, a power supply unit for the heating assembly 123 is cut off, and the heating assembly 123 is turned off and stop heating, but at this time, the blowing assembly 13 is normally operated.

Third Embodiment

This embodiment provides a hair dryer. The hair dryer in the third embodiment differs from the hair dryer in the second embodiment in that the main control PCB 24 is electrically connected to the blowing assembly 13 and an auxiliary temperature detecting element capable of detecting a temperature near the blowing assembly 13. The main control PCB 24 controls a main power supply unit to work and stop according to a temperature value obtained by the auxiliary temperature detecting element.

If the temperature of the blowing assembly 13 is too high, the blowing assembly 13 is determined to work too long or work abnormally. The main control PCB 24 immediately turns off a power supply unit of the blowing assembly 13. In a condition that the blowing assembly 13 stops, the heating assembly 123 operates alone and will be overheating for no cold air passing through it, which makes the power supply of the heating assembly 123 have to be cut off at the same time. Therefore, when the temperature of the blowing assembly 13 is too high, the main control PCB 24 is required to cut off the power supplies of the blowing assembly 13 and the heating assembly 123, that is, to turn off the main power supply unit.

The blowing assembly 13 is connected in parallel to the heating assembly 123, which is convenient for independent control of the two. The temperature detecting element 17 and the auxiliary temperature detecting element are connected in parallel to prevent mutual interference between detecting results of the two.

A third temperature preset value is prestored in the storage unit of the main control PCB 24. When a temperature value obtained by the auxiliary temperature detecting element is higher than the third temperature preset value, the temperature of the blowing assembly 13 is determined to be too high, and thus the main control PCB 24 will turn off the main power supply unit. Herein, the magnitude of the third temperature preset value is not limited, and can be set according to actual conditions.

In the above case, the reason for the overheating of the blowing assembly 13 may be long-term operation of the blowing assembly 13 or failure of the blowing assembly 13, and an operator may turn on the main power supply unit for detection after the hair dryer stands for a period of time for cooling. If no airflow is blown out when the hair dryer is turned on again, the blowing assembly 13 is determined to be faulty, which facilitates a timely maintenance. If the airflow is blown out normally when the hair dryer is turned on again, it is determined that the blowing assembly 13 had worked for too long last time.

The temperature detecting element 17 and the auxiliary temperature detecting element work in cooperation to each other to play a double protection for the hair dryer and prevent inaccurate detection due to a failure of one of them.

Fourth Embodiment

This embodiment provides a hair dryer. The hair dryer in the fourth embodiment differs from the hair dryer in the second embodiment in that an air speed sensor is disposed at the air outlet 102 of the hair dryer, and the air speed sensor is electrically connected to the main control PCB 24. The air speed sensor is used to detect an air speed at the air outlet 102. The air speed sensor is cooperated with the temperature detecting element to provide multiple protections for the hair dryer.

While the hair dryer is in the drying mode, the temperature of the heating assembly 123 detected by the temperature detecting element 17 may be too high. Reasons for that may be a fact that the blowing assembly 13 is stopped or the air outlet is blocked, in addition to the fact that operating time of the heating assembly 123 is too long. At this time, the main control PCB 24 controls the heating assembly 123 to be turned off and stop heating, and makes a comprehensive determination according to an air speed value detected by the air speed sensor.

If the air speed value obtained by the air speed sensor is lower than an air speed preset value, the blowing assembly 13 is determined to be in a fault and stop rotating. The main control PCB 24 can turn off the blowing assembly 13 while stopping the heating assembly 123. That is, the main power supply unit is turned off, and the blowing assembly 13 is repaired. In addition, if the air speed value obtained by the air speed sensor is normal, the blowing assembly 13 is determined to be normal. The main control PCB 24 can only stop the heating assembly 123, and the blowing assembly 13 is used to dissipate heat from the heating assembly 123, and the air outlet is checked and processed at the same time.

Therefore, the arrangement of the air speed sensor is beneficial to further determine the state of the hair dryer, and thus a better processing method may be adopted. Herein, the air speed preset value pre-stored in the main control PCB 24 is not limited, and can be set according to actual conditions.

If the hair dryer is determined to be in a fault, the main control PCB 24 can alarm via alarm lamps with different colors according to the different types of the faults, so that the targeted maintenance of a user is facilitated.

Fifth Embodiment

This embodiment provides a hair dryer. The hair dryer in the fifth embodiment differs from the hair dryer in the second embodiment in that the motor in this embodiment is provided with a rotation speed sensor thereon, and the rotation speed sensor is electrically connected to the main control PCB 24. The rotation speed sensor is used to detect a rotation speed of the motor. The rotation speed sensor is cooperated with the temperature detecting element to provide multiple protections for the hair dryer.

While the hair dryer is in the drying mode, the temperature of the heating assembly 123 detected by the temperature detecting element 17 may be too high. Reasons for that may be a fact that the blowing assembly 13 is stopped or the air outlet is blocked, in addition to the fact that operating time of the heating assembly 123 is too long. At this time, the main control PCB 24 controls the heating assembly 123 to be turned off and stop heating, and makes a comprehensive determination according to a rotation speed value detected by the rotation speed sensor.

If the rotation speed of the blowing assembly 13 is within a rotation speed preset range, it is determined that the air outlet may be blocked. At this time, only the heating assembly 123 is stopped while the blowing assembly 13 is used to dissipate heat from the heating assembly 123, and the air outlet is checked and processed at the same time. If the hair dryer is mounted with a heat dissipation device, the heat dissipation device can be turned on for heat dissipation at this time. Alternatively, the hair dryer is stopped to dissipate the heat. The hair dryer can still be used again after being cooled down. If the rotation speed of the blowing assembly 13 is abnormal, the blowing assembly 13 is determined to be in a fault and stops rotating. In this case, the main control PCB 24 can turn off the blowing assembly 13 while stopping the heating assembly 123, that is, turn off the main power supply unit, and the blowing assembly 13 is repaired.

The rotation speed preset range is prestored in the storage unit of the main control PCB 24. The rotation speed value detected by the rotation speed sensor is compared with two end point values of the rotation speed preset range. If the rotation speed value is not within the rotation speed preset range, the rotation speed of blowing assembly 13 is determined to be abnormal.

If the temperature value obtained by the temperature detecting element 17 is lower than the second temperature preset value, the rotation speed value obtained by the rotation speed sensor is ensured to be within the rotation speed preset range before the heating assembly 123 is turned on. That it, under the circumstance that the blowing assembly 13 is in a normal operating state, the heating assembly 123 is turned on to ensure operating safety.

Therefore, the arrangement of the rotation speed sensor is beneficial to further determine the state of the hair dryer, and thus a better processing method may be adopted.

Sixth Embodiment

This embodiment provides a hair dryer. The hair dryer in the sixth embodiment differs from the hair dryer in the aforementioned embodiments in that a secondary air passage is configured in the handle 200 in this embodiment, and the secondary air passage is in communication with the main air passage.

Specifically, as shown in FIG. 12, the handle 200 includes a case 21 and a connecting member 25. A secondary air passage is formed in the case 21. An upper end of the case 21 is connected to the mounting opening 103 on the blower cylinder 100, and a lower end of the case 21 is connected to the power line 400 via the connecting member 25. The connecting member 25 may have a grille structure with a hollowed-out area in communication with the interior of the case 21. The hollowed-out area may be used as an airflow inlet of the secondary air passage. When the hair dryer operates, air near the handle 200 enters the secondary air passage from the airflow inlet under the action of air pressure difference, passes through the main control PCB 24 and the negative ion generator 23 in the handle 200, and then enters the main air passage. By providing the secondary air passage, on the one hand, the stability of the airflow in the hair dryer can be increased, such that the airflow flows more smoothly, and on the other hand, the heat dissipation effect of the electrical elements in the handle 200 can be improved, and the handle 200 can be prevented from getting hotter and hotter when the hair dryer is in use, thereby improving the user's use experience.

Optionally, the case 21 is further provided with an inner case 21 therein. The main control PCB 24 and the negative ion generator 23 are disposed on the inner case 21. The inner case 21 includes a left case 221 and a right case 222. The left case 221 and the right case 222 can be fixed by screws. The inner case 21 can protect the main control PCB 24 and the negative ion generator 23. When the main control PCB 24 and the negative ion generator 23 are maintained, the inner case 21 can be slid out of the case 21. Then, the left case 221 and the right case 222 are detached from each other by removing the screws, which avoids a damage to the main control PCB 24 and the ion generator during the detaching and mounting process.

Seventh Embodiment

Figure 13:
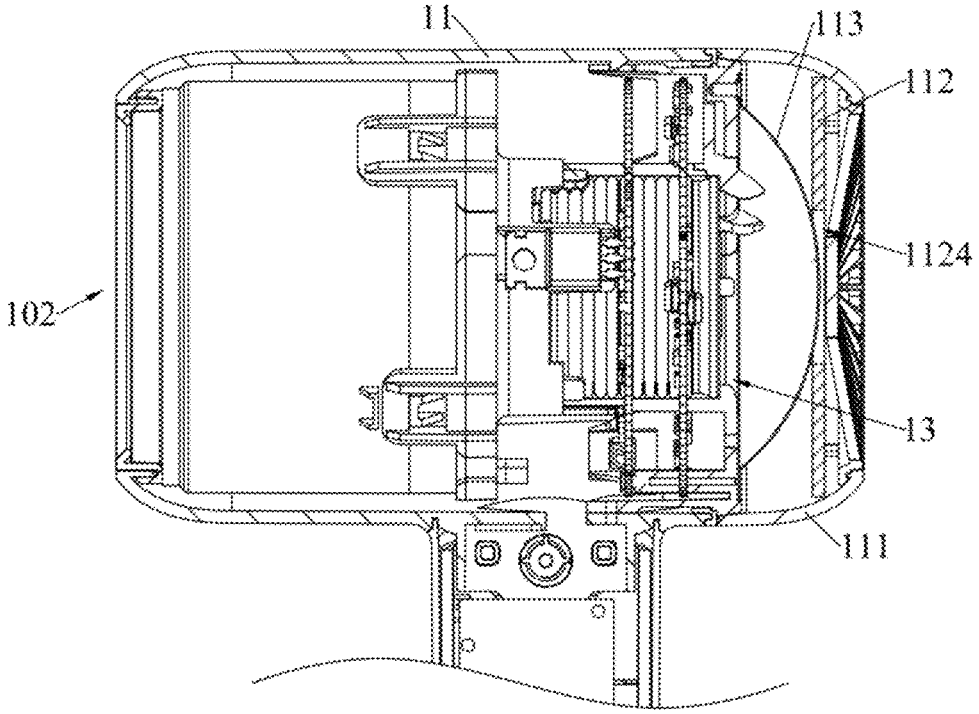
FIG. 13 is a cross-sectional view of a hair dryer according to a seventh embodiment of the present disclosure.

This embodiment provides a hair dryer. The difference of hair dryer of this embodiment over those in the aforementioned embodiments is as follows. As shown in FIG. 13, the blower cylinder 100 of this embodiment is provided with a protective cover 111 and a filter device at the position of the air inlet. Specifically, the housing 11 of the blower cylinder 100 includes a cylinder body and the protective cover 111 located at the air inlet side. The protective cover 111 is detachably connected to the cylinder body. The protective cover 111 is provided with a filter assembly 112 therein. The air enters the blowing chamber through the filter assembly 112. The filter assembly 112 can effectively remove foreign matters such as dust, hair and the like in the air, so as to play the effects of purifying the air and preventing the blower in the blower cylinder 100 from being wound and blocked by the foreign matters. With the help of the detachable connection of the filter assembly 112 and the protective cover 111, after the filter assembly 112 is used for a long time, the operator can first detach the protective cover 111 from the blower cylinder 100, and then detach the filter assembly 112 from the protective cover 111. Then, the filter assembly 112 is individually cleaned completely and thoroughly, such that the cleaned filter assembly 112 has a better filtering effect. In addition, with the help of the detachable connection of the filter assembly 112 and the protective cover 111, if one of the filter assembly 112 or the protective cover 111 is damaged, only the damaged part needs to be replaced, and there is no need to replace the filter assembly 112 and the protective cover 111 simultaneously, which effectively reduces the maintenance cost of the hair dryer.

Figure 14:
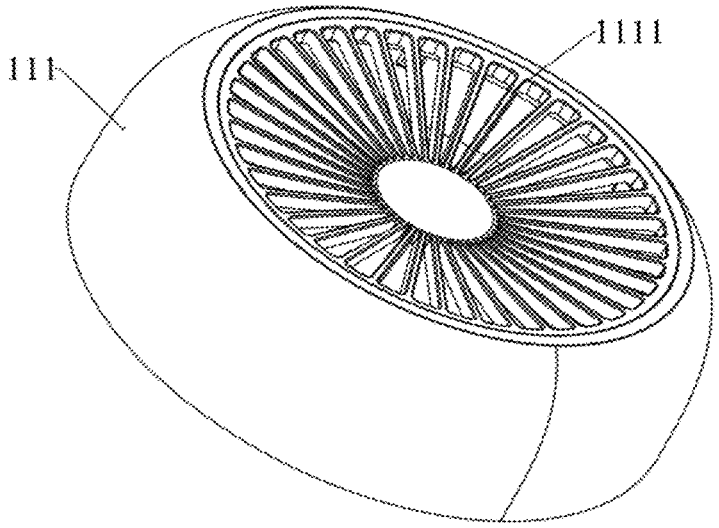
FIG. 14 is a schematic view of a protective cover according to the seventh embodiment of the present disclosure.

As shown in FIGS. 13 and 14, the filter assembly 112 in this embodiment may be a filter sponge or a filter screen. The filter sponge or filter screen can be latched on an inner wall of the protective cover 111, so that the detachable connection of the filter sponge or filter screen and the protective cover 111 is achieved without providing additional fixing assemblies between the filter assembly 112 and the protective cover 111, which simplifies the overall structure of the hair dryer and improves the detaching and mounting efficiency of the filter assembly 112 and the protective cover 111.

In addition, since pores of the filter sponge or filter screen are small, the filter sponge or filter screen can filter dust with a small diameter and fine hair, which can prevent the dust with a small diameter and the fine hair from entering the air passage of the blower cylinder 100, and thus the user experience is improved. Preferably, a pore density (PPI, pores per linear inch) of the filter sponge is not less than 40 PPI, and the mesh number of the filter screen is not less than 40, so that the filter assembly 112 can effectively filter the foreign matters such as dust, hair and the like, without inletting air volume of the hair dryer reduced by the filter assembly 112. The pore density refers to the average number of pores per inch of length. The mesh number refers to the number of pores within one inch of the filter screen.

As shown in FIG. 14, one end surface of the protective cover 111 is connected to the cylinder body, and the other end surface thereof is provided with an air inlet grille 1111. The air inlet grille 1111 forms the air inlet 101. The air inlet grille 1111 includes a plurality of pillars symmetrically disposed with respect to the axis of the blower cylinder 100. The air inlet grille 1111 is integrally of a hollowed-out structure to ensure that the air enters the protective cover 111 more smoothly and prevent the hand of an operator from reaching into the hair dryer.

The protective cover 111 is further provided with a filter hood 113. The filter hood 113 is provided with a plurality of filtering holes. The air passes through the filter assembly 112 and the filter hood 113 in sequence. After the two-stage filtration of the filter assembly 112 and the filter hood 113, the air enters the air passage of the blower cylinder 100, which further improves the filtering effect on the dust and hair compared with the solution in which only the filter assembly 112 is provided.

The hair dryer will vibrate during use, and the filter assembly 112 may fall from the protective cover 111 under the influence of vibrations and thus be stirred into the blowing assembly in the blower cylinder 100, which will cause the blower in the blowing assembly to be wound and blocked, and even cause the blower to be burned, affecting the use safety of users. In order to solve the above technical problems, the filter hood 113 is configured as a stainless-steel mesh hood provided with a plurality of filtering holes. The stainless-steel mesh hood can effectively block the filter assembly 112 outside the blower cylinder 100, preventing the filter assembly 112 from entering the inside of the blowing assembly, and thus the normal operation of the blower can be ensured, ensuring the use safety of users.

The filter hood 113 protrudes towards the air inlet grille 1111, and thus more filtering holes can be formed on the filter hood 113, so that a sum of the cross-sectional areas of the plurality of filtering holes on the stainless-steel mesh hood is larger than the cross-sectional area of the air inlet of the blowing assembly. In this case, the air can enter the blowing assembly smoothly, such that the blowing effect of the hair dryer is better.

In order to reduce the length of the blower cylinder 100, the filter assembly 112 is provided with a first avoiding hole 1124. At least a portion of the filter hood 113 is accommodated in the first avoiding hole 1124, such that the filter assembly 112 and the filter hood 113 are arranged to be more compact along the length direction of the blower cylinder 100. Therefore, the overall volume of the hair dryer is smaller, and the hair dryer is convenient to be carried.

Eighth Embodiment

Figure 15:
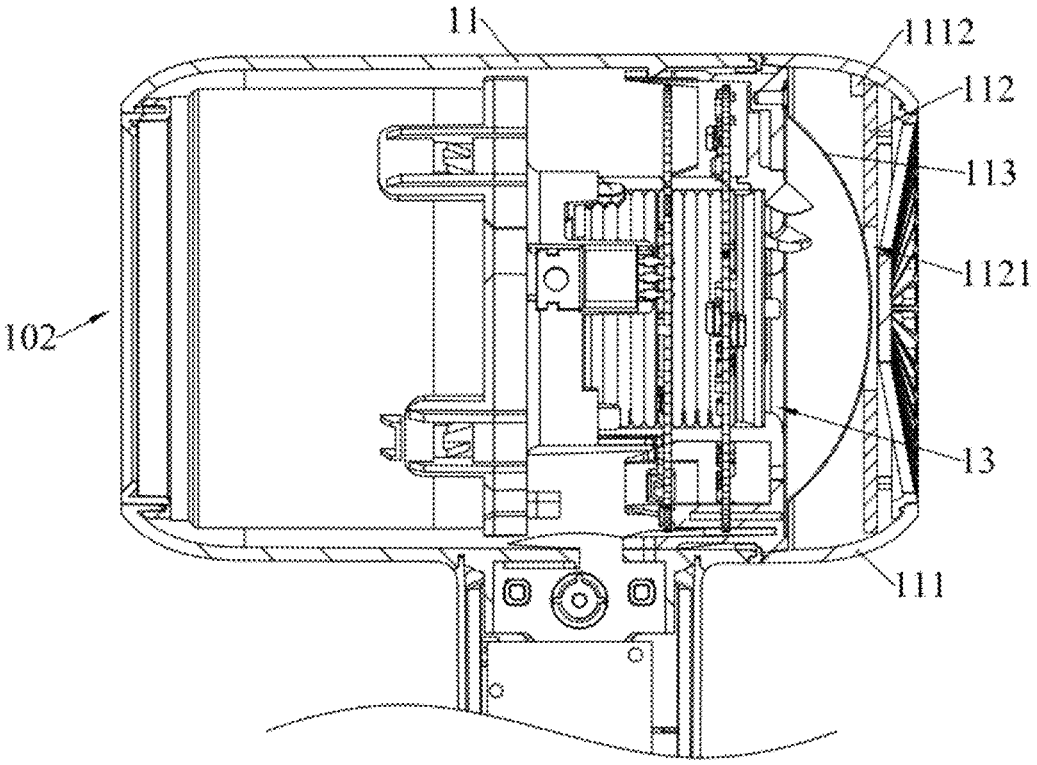
FIG. 15 is a cross-sectional view of a hair dryer according to an eighth embodiment of the present disclosure.
Figure 16:
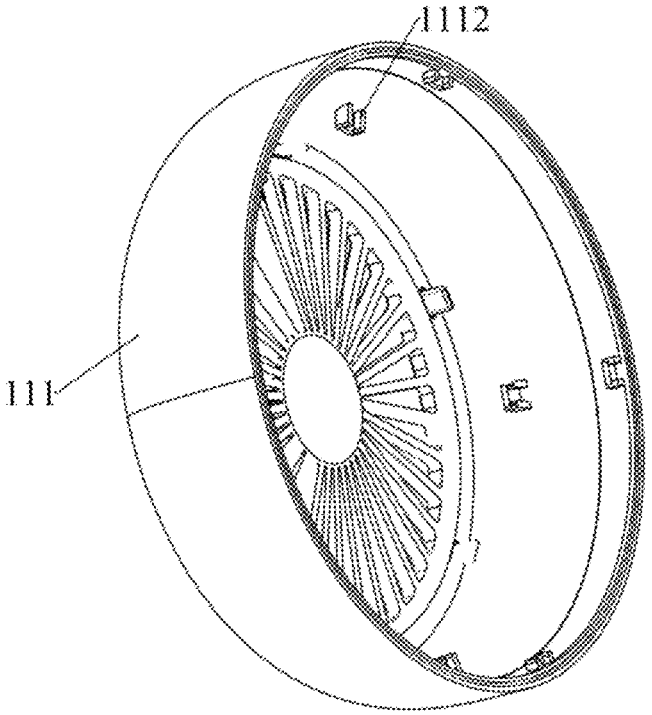
FIG. 16 is a schematic view of a protective cover according to the eighth embodiment of the present disclosure.

This embodiment discloses a hair dryer. The hair dryer in the eighth embodiment differs from the hair dryer in the seventh embodiment in that, as shown in FIGS. 15 and 16, an inner wall of the protective cover 111 is provided with a plurality of latching blocks 1112 along the circumferential direction. A mounting space for accommodating the filter assembly 112 is formed between the latching blocks 1112 and the air inlet grille 1111. By providing the latching blocks 1112, a movement of the filter assembly 112 relative to the protective cover 111 along the axial direction of the protective cover 111 can be limited, so that the filter assembly 112 and the protective cover 111 can be fixed better. In order to further improve the limiting effect of the latching block 1112 on the filter assembly 112, the plurality of latching blocks 1112 may be uniformly distributed along the circumferential direction of the protective cover 111.

In this embodiment, the latching block 1112 and the protective cover 111 can be integrally formed, which can simplify the processing steps of the protective cover 111 and improve the production efficiency of the protective cover 111.

Ninth Embodiment

Figure 17:
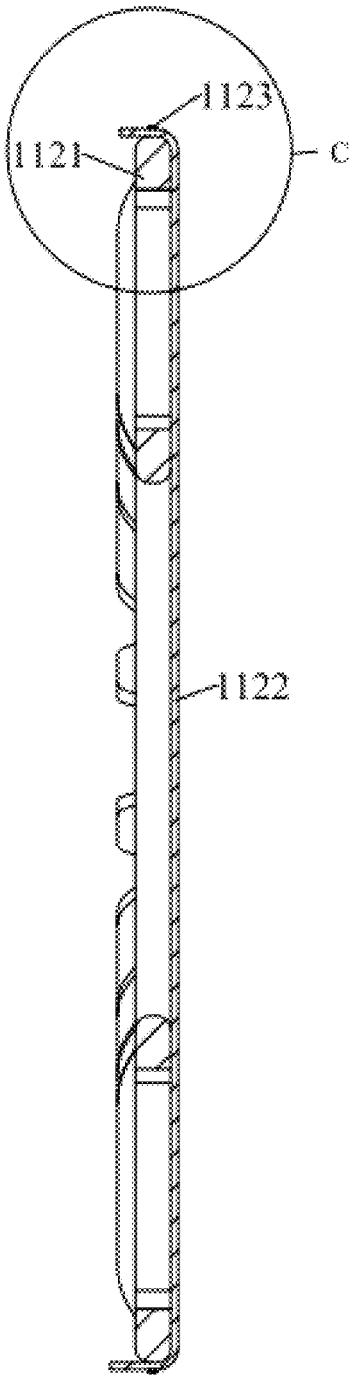
FIG. 17 is a cross-sectional view of a filter assembly according to a ninth embodiment of the present disclosure.
Figure 18:
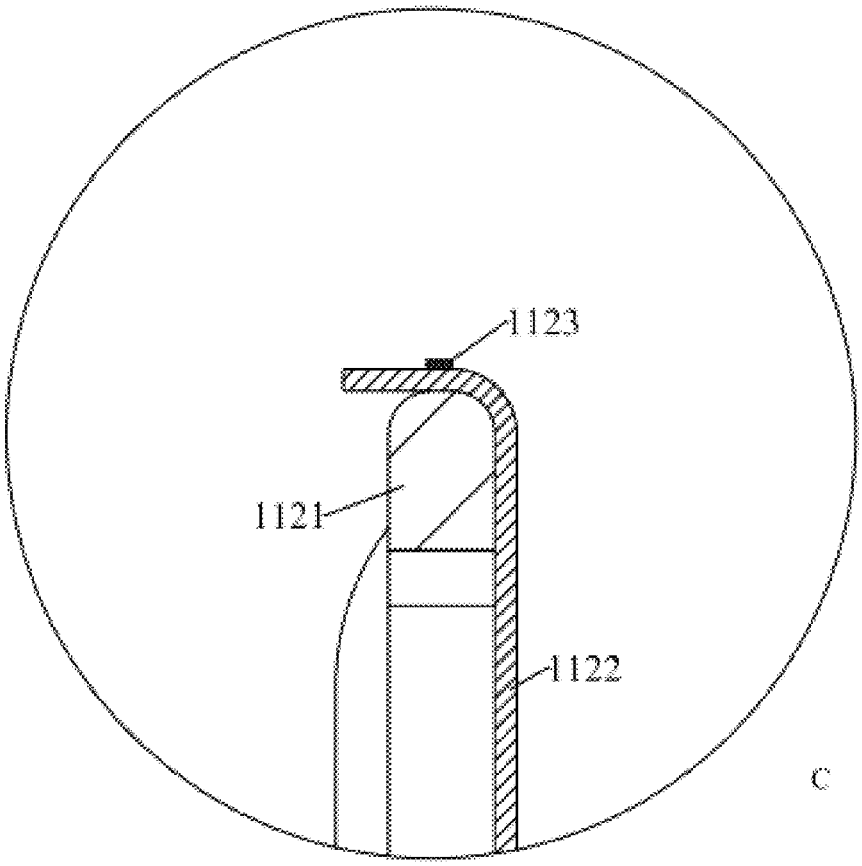
FIG. 18 is an enlarged view of a portion C in FIG. 17.
Figure 19:
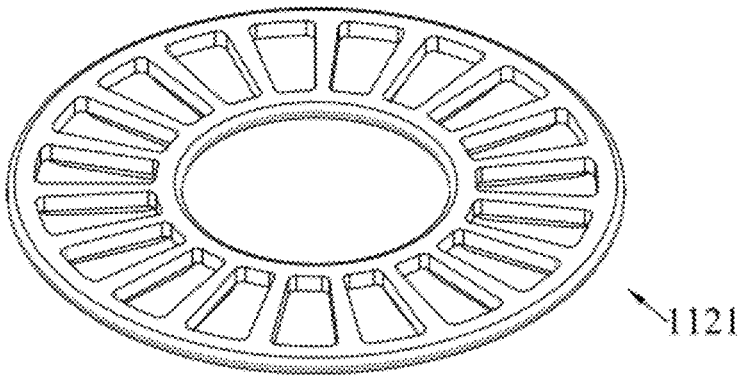
FIG. 19 is a schematic view of a bracket according to the ninth embodiment of the present disclosure.
Figure 20:
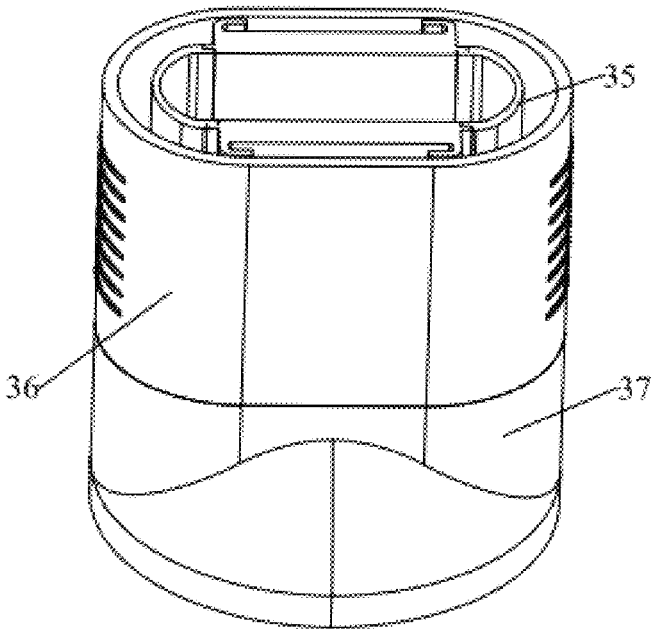
FIG. 20 is a schematic view of a nozzle in an orientation according to an eleventh embodiment of the present disclosure.
Figure 21:
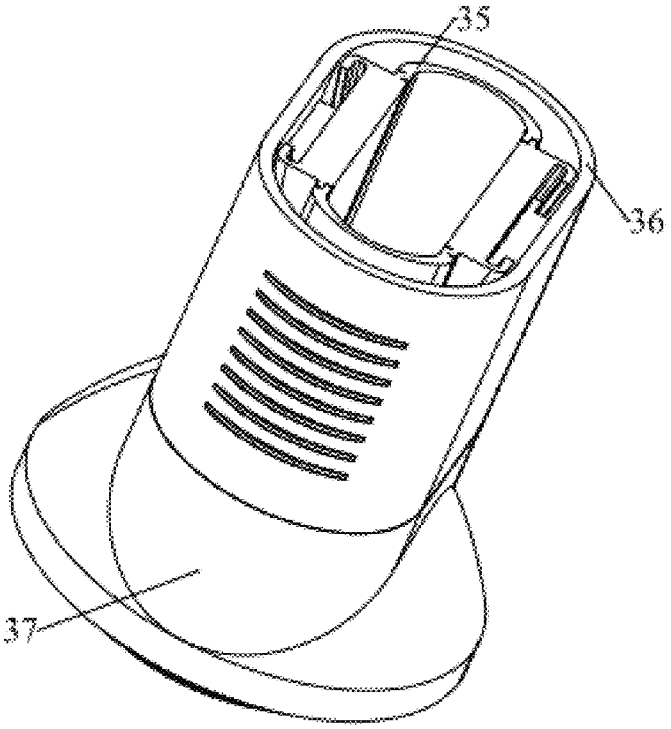
FIG. 21 is a schematic view of the nozzle in another orientation according to the eleventh embodiment of the present disclosure.
Figure 22:
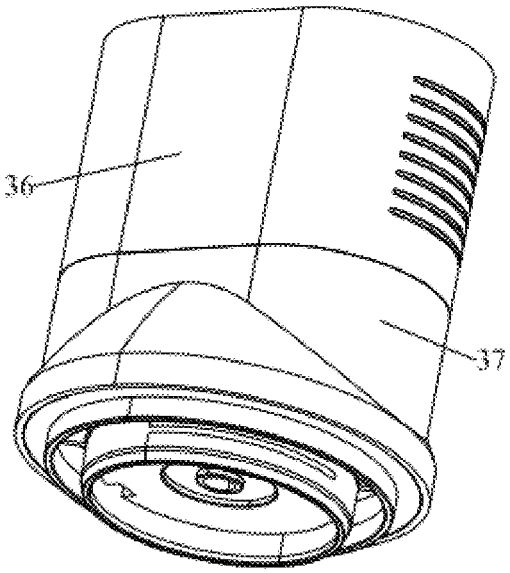
FIG. 22 is a schematic view of the nozzle in yet another orientation according to the eleventh embodiment of the present disclosure.
Figure 23:
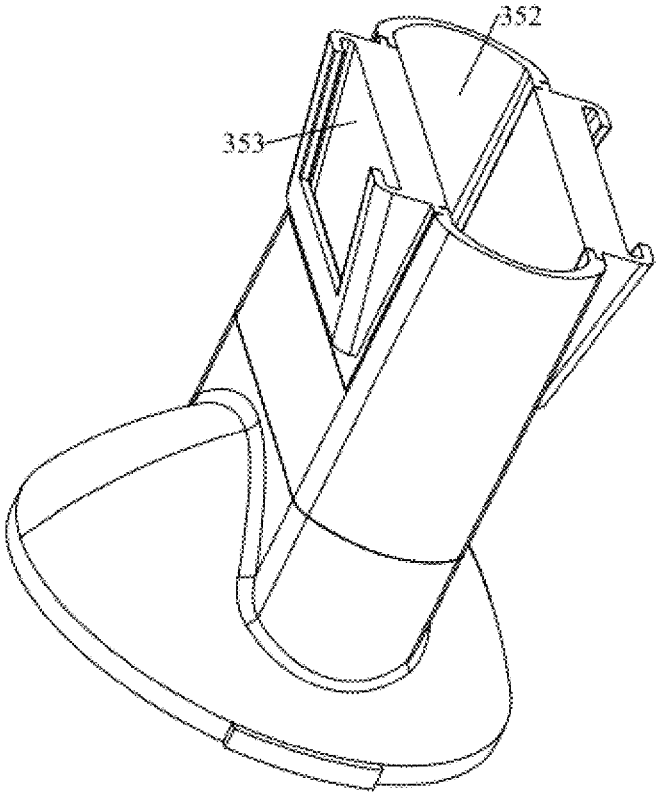
FIG. 23 is a schematic view of an air guiding member in an orientation according to the eleventh embodiment of the present disclosure.
Figure 24:
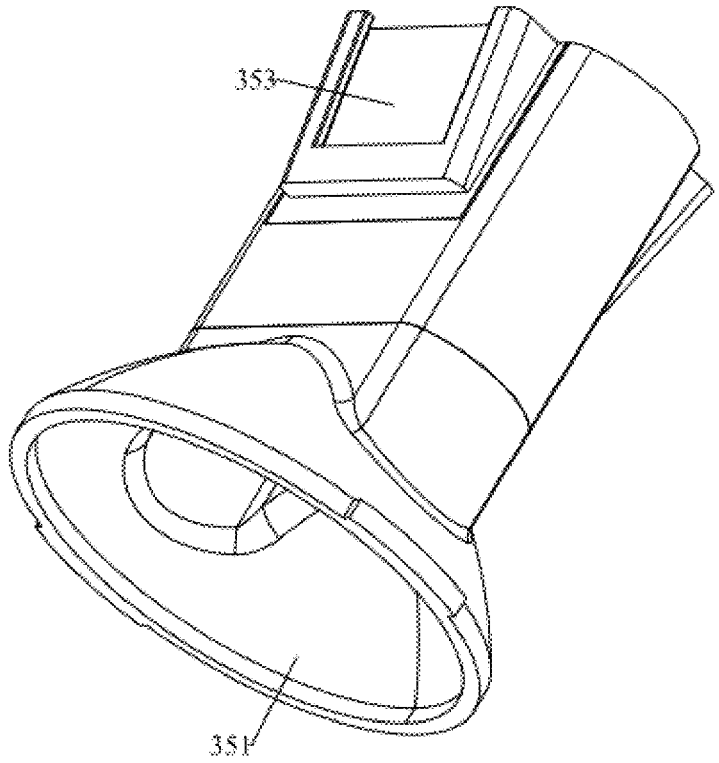
FIG. 24 is a schematic view of the air guiding member in another orientation according to the eleventh embodiment of the present disclosure.
Figure 25:
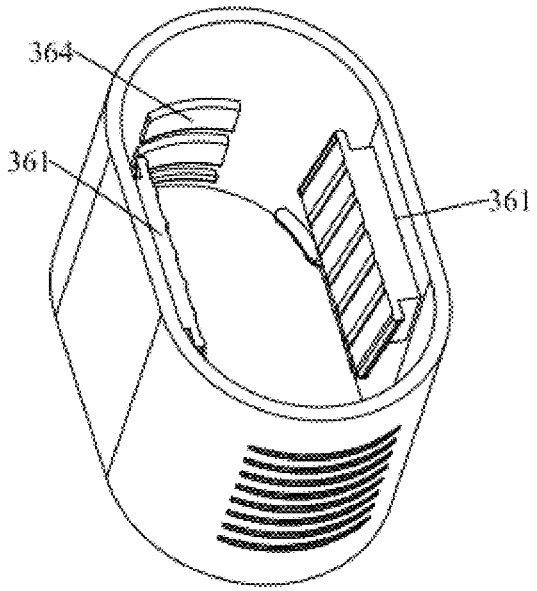
FIG. 25 is a schematic view of an adjusting member according to the eleventh embodiment of the present disclosure.
Figure 26:
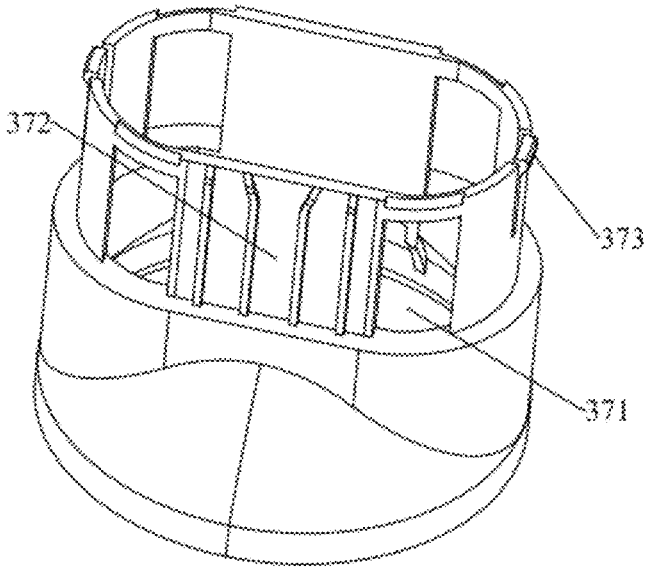
FIG. 26 is a schematic view of a connecting portion according to the eleventh embodiment of the present disclosure.
Figure 27:
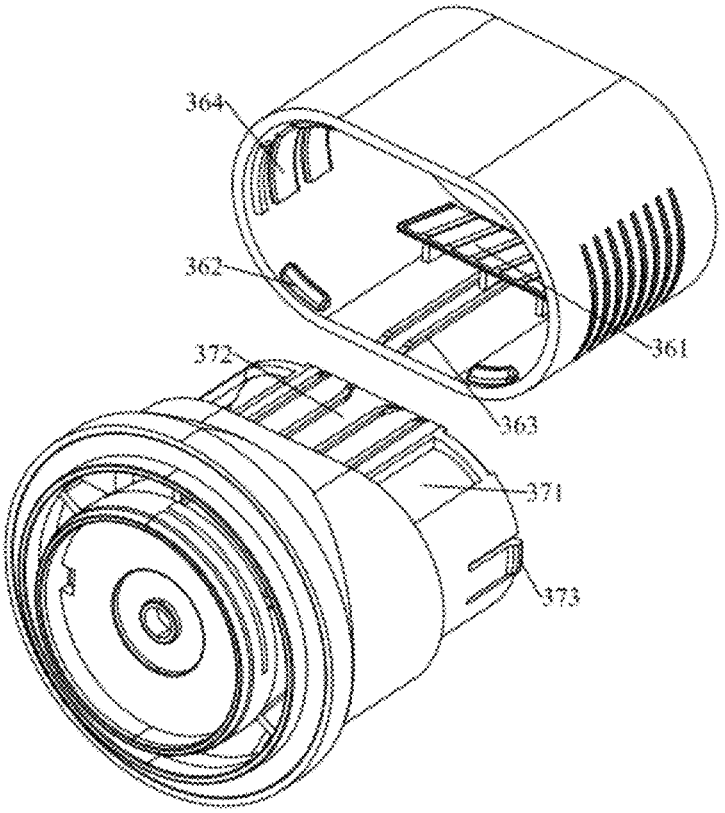
FIG. 27 is a schematic view of the adjusting member detached from the connecting portion according to the eleventh embodiment of the present disclosure.

This embodiment discloses a hair dryer. The hair dryer in the ninth embodiment differs from the hair dryer in the eighth embodiment in that, as shown in FIGS. 17 to 19, the filter assembly 112 in this embodiment is a filter cloth 1122. Since pores on the filter cloth 1122 have a smaller size than those on the filter screen or filter sponge, the filter cloth 1122 can achieve the filtration to smaller dust or hair, and the hair dryer therefore has a better filtering effect than the hair dryer in the eighth embodiment.

Since texture of the filter cloth 1122 is relatively soft, it is difficult to directly fix the filter cloth 1122 in the protective cover 111, and it is inconvenient to detach or mount the filter cloth 1122 on the protective cover 111. Therefore, the filter assembly 112 of this embodiment further includes a bracket 1121. The filter cloth 1122 is covered and spreads on the bracket 1121, such that the filter cloth 1122 is tensioned. By latching the outer periphery of the bracket 1121 onto the inner wall of the protective cover 111, the filter cloth 1122 and the protective cover 111 can be fixed to each other, which facilitates the detaching and mounting of the filter cloth 1122 on the protective cover 111. Preferably, in the embodiment, diameters of the pores of the filter cloth 1122 do not exceed 0.3 mm, respectively, and thus the filter assembly 112 can be ensured to have a better filtering effect and a better ventilation effect. In addition, the bracket 1121 is provided with vents, which can ensure that the air can pass through the filter assembly 112 fluently.

In other embodiments, since the texture of the thinner filter sponge or filter screen is also softer, the thinner filter sponge or filter screen can also be mounted on the bracket 1121 first, and then the bracket 1121, through its outer periphery, is latched onto the inner wall of the protective cover 111.

The filter cloth 1122 needs to be replaced after being used for a period of time. In order to replace of the filter cloth 1122 conveniently, the filter assembly 112 of this embodiment further is configured to include an annular fixing hoop 1123. The filter cloth 1122, through its outer periphery, is latched between the annular fixing hoop 1123 and the bracket 1121. After the annular fixing hoop 1123 is detached from the bracket 1121, the filter cloth 1122 can be removed from the bracket 1121 for replacement.

The filter cloth 1122 is covered on a surface of the bracket 1121 facing away from the air inlet 101. When the hair dryer is in use, the air passes through the filter cloth 1122 and the bracket 1121 in sequence. The force of the air acting on the filter cloth 1122 can press the filter cloth 1122 against the bracket 1121, and the bracket 1121 supports the filter cloth 1122, so that the filter cloth 1122 can be prevented from being separated from the bracket 1121.

An axis of the filter assembly 112 coincides with the axis of the blower cylinder 100. The bracket 1121 includes the plurality of pillars disposed symmetrically with respect to the axis of the blower cylinder 100. When the filter cloth 1122 is pressed against the bracket 1121, the filter cloth 1122 can be uniformly stressed, which avoids a damage caused by excessively concentrated stress in some areas of the filter cloth 1122, and prolongs the service life of the filter cloth 1122.

In this embodiment, the bracket 1121 is also provided with a second avoiding hole. The filter hood 113 and the filter cloth 1122 are located on both sides of the bracket 1121 along the axial direction of the blower cylinder 100, and at least a portion of the filter hood 113 is located in the second avoiding hole. With this structure, the arrangement of the filter hood 113 and the bracket 1121 along the axial direction of the blower cylinder 100 is more compact. Therefore, the size of the hair dryer along the axial direction of the blower cylinder 100 is small, the overall volume of the hair dryer is therefore smaller, and the hair dryer is convenient to be carried.

Tenth Embodiment

This embodiment provides a hair dryer. The difference of hair dryer of this embodiment over those in the aforementioned embodiments is as follows. As shown in FIGS. 4 and 10, the nozzle 300 and the blower cylinder 100 are fixed together by attraction force of a magnet 16. The magnet 16 is disposed in a hidden manner, such that the hair dryer has a good aesthetics.

Specifically, the blower cylinder 100 is provided with the magnet 16 on an inner side of the air outlet. The magnet 16 is disposed on the inner side of a downstream end surface of the outer cylinder 121. The nozzle 300 is provided with an attracting block that cooperates with the magnet 16 through the attraction force. Through the cooperation of the magnet 16 and the attracting block, the nozzle 300 can be fixed to the blower cylinder 100.

In this embodiment, the outer cylinder 121 is provided with a latching slot at the inner side of the downstream end surface thereof. The magnet 16 is embedded in the latching slot, so that the magnet 16 is fixed in the radial and circumferential directions of the outer cylinder. The end of the inner cylinder 122 is provided with a limiting post. The limiting post abuts against the magnet 16, such that the magnet 16 abuts against the downstream end surface of the outer cylinder 121, thereby achieving the axial fixation of the magnet 16.

Optionally, the magnet 16 may be ring-shaped. The ring-shaped magnet 16 may be disposed around the ion outlet 1211 to prevent the magnet 16 from blocking the ion outlet 1211. The downstream end surface of the outer cylinder 121 may be provided with a grille structure around the ion outlet 1211, and thus forms the air outlet 102. The magnet 16 is located between the air outlet 102 and the ion outlet 1211.

Optionally, the attracting block may be an iron sheet. The iron sheet can be disposed on the outer side or inner side of the nozzle 300, as long as it can be attracted by the magnet 16, thereby providing sufficient fixed attractive force for the nozzle 300.

Eleventh Embodiment

This embodiment provides a hair dryer. The hair dryer in the eleventh embodiment differs from the hair dryer in the aforementioned embodiments in that the nozzle 300 in this embodiment can adjust outlet air volume according to the needs of the user, without replacing the nozzle 300, which makes the hair dryer used more conveniently.

Specifically, as shown in FIGS. 20 to 27, the nozzle includes an air guiding member and an adjusting member 36. The air guiding member is provided with an inlet 351, an outlet 352, and an air channel providing a communication between the inlet 351 and the outlet 352. The adjusting member 36 is sleeved outside the air guiding member and can be moved relative to the air guiding member. A size of a cross section at a certain position on the air channel can be adjusted by the movement of the adjusting member 36 relative to the air guiding member.

In the present disclosure, an air outlet area can be adjusted with the help of one nozzle which includes the air guiding member and the adjusting member 36 cooperated with each other. Thus, it is simple and convenient to use and adjust the hair dryer, avoiding providing a plurality of nozzles, and improving the actual value of the nozzle.

Optionally, the air guiding member is provided with a deformation area made of soft rubber. When moved relative to the air guiding member, the adjusting member 36 can apply an acting force to the air guiding member. The deformation area is deformed after the air guiding member is stressed, such that a cross-sectional area of the air passage at the position of the deformation area can be adjusted. In this embodiment, the deformation area is disposed at an edge of the air outlet 102 on the air guiding member, such that the size of the air outlet 102 can be adjusted by means of the deformation of the deformation area caused by pressing of the adjusting member 36.

Specifically, the air guiding member is made of soft rubber as a whole and can be deformed when subjected to a force. In addition, the air guiding member may also be provided to include a deformation portion made of soft rubber, and the other portions made of hard rubber.

Optionally, a force-bearing block 353 is provided on the air guiding member, and a force applying block 361 is provided on the adjusting member 36. When the adjusting member 36 is moved relative to the air guiding member, the force applying block 361 presses or stretches the force-bearing block 353, so that the deformation area is deformed, and the cross-sectional area of the air passage at this position is therefore adjusted.

Specifically, the force-bearing block 353 may be disposed in the deformation area, or may also be disposed proximity to the deformation area in the circumferential direction of the air guiding member. In this embodiment, a segment of the air guiding member at the air outlet has a flat columnar structure. Two force-bearing blocks 353 are respectively disposed in a flat and straight area that is located on both sides of the columnar structure in a thickness direction of the columnar structure, and the flat and straight area is a non-deformation area. In a circumferential direction of the columnar structure, an arc-shaped area adjacent to the non-deformation area is the deformation area.

Optionally, the force-bearing block 353 is a groove, and the force applying block 361 is a convex block (in addition, the force-bearing block 353 may be a convex block, and the force applying block 361 is a groove). An extending direction of at least one of the force-bearing block 353 and the force applying block 361 is set at an angle to an axis of the air passage, and gradually approaches the axis of the air passage from the air outlet inwardly. The force applying block 361 is latched to the force-bearing block 353. The convex block of the force applying block 361 may extend obliquely toward the axis of the air passage. The groove of the force-bearing block 353 may be sleeved on different positions of the force applying block 361 along the extending direction of the force applying block 361, thereby changing the cross-sectional area of the air passage at the position of the deformation area. As another example, the groove of the force-bearing block 353 may extend obliquely toward the axis of the air passage, and the convex block of the force applying block 361 can be latched at different positions of the force-bearing block 353 along the extending direction of the force-bearing block 353, thereby changing the cross-sectional area of the air passage at the position of the deformation area. As yet another example, the convex block of the force applying block 361 and the groove of the force-bearing block 353 may extend obliquely toward the axis of the air passage, and the cross-sectional area of the air passage at the position of the deformation area is changed by adjusting the length of the latching portion of the convex block of the force applying block 361 and the groove of the force-bearing block 353.

In this embodiment, both the convex block of the force applying block 361 and the groove of the force-bearing block 353 extend obliquely toward the axis of the air passage, such that when the adjusting member 36 is moved on the air guiding member toward the air outlet, the air outlet becomes smaller for the inner wall of the force-bearing block 353 facing the air passage is pressed by the force applying block 361, and when the adjusting member 36 is moved toward the air inlet, the air outlet becomes larger (if the air passage cannot be elastically restored, the force applying block 361 presses against the inner wall of the force-bearing block 353 away from the air passage, and if the air passage can be elastically restored, the pressure applied by the force applying block 361 onto the inner wall of the force-bearing block 353 facing the air passage will be gradually relaxed). On the whole, the area of the air outlet is adjusted by the movement of the adjusting member 36 relative to the air guiding member. In addition to the above configuration, from the air outlet to the inside of the air passage, the force applying block 361 and the force-bearing block 353 can also gradually extend away from the axis of the air passage. In this structure, when the adjusting member 36 is moved toward the air outlet, the air outlet becomes larger, and when the adjusting member 36 is moved toward the air inlet, the air outlet becomes smaller.

Optionally, the air guiding member includes a connecting portion 37 and an air outlet portion 35 that are connected to each other. The air inlet is disposed on the connecting portion 37. The air outlet and the deformation area are disposed on the air outlet portion 35. The nozzle that can adjust the air volume is connected to a body of the hair dryer via the connecting portion 37. The air passage is configured to extend through the connecting portion 37 and the air outlet portion 35.

The adjusting member 36 is connected to the connecting portion 37, can move relative to the connecting portion 37, and can apply a force on the deformation area when moving.

Specifically, the air outlet portion 35 has a flat cylindrical structure. The air outlet portion 35 is provided with one deformation area on each of the two opposite sides in the thickness direction thereof. Each deformation area is provided with one force-bearing block 353. Two force applying blocks 361 are provided, which are disposed on the inner wall of the ring-shaped adjusting member 36, and are latched into the two force-bearing blocks 353, respectively. By providing the two force-bearing blocks 353 and the two force applying blocks 361, force can be applied to the air outlet portion 35 in two directions simultaneously, which improves the efficiency of adjusting the area of the air outlet and the adjusting effect.

Optionally, the adjusting member 36 is connected to the connecting portion 37 by an anti-falling structure. The anti-falling structure is used to prevent the adjusting member 36 from being detached from the connecting portion 37.

Specifically, the anti-falling structure includes a connecting protrusion 362 and a connecting hole 371, one of which is disposed on the adjusting member 36 and the other is disposed on the connecting portion 37. The connecting hole 371 has an elongated shape, and has an extending direction parallel to the axis of the air passage. The connecting protrusion 362 can slide in the connecting hole 371 along the extending direction of the connecting portion 37. In this embodiment, the adjusting member 36 is partially sleeved outside the connecting portion 37. The connecting protrusion 362 is disposed on an inner wall of the adjusting member 36. The connecting hole 371 is disposed on an outer wall of the connecting portion 37. Therefore, the adjusting member 36 can move relative to the connecting portion 37, without detached from the connecting portion 37. In order to facilitate the latching installation of the connecting protrusion 362, the connecting hole 371 is provided with a guiding groove at an outer edge thereof facing the air outlet, such that the connecting protrusion 362 can be conveniently latched into the connecting hole 371 when the anti-falling structure is assembled. In other examples, the anti-falling structure may also be configured as a connecting line, other than the connecting protrusion 362 and the connecting hole 371.

Optionally, the adjusting member 36 and the connecting portion 37 are provided with guiding structures which are worked in a cooperative manner. The adjusting member 36 can slide along the axial direction of the air passage under the guidance of the guiding structures.

Specifically, the guiding structures include a guiding plate 363 and a guiding groove 372, one of which is disposed on the adjusting member 36 and the other is disposed on the connecting portion 37. The guiding plate 363 is at least partially latched into the guiding groove 372. The guiding plate 363 and the guiding groove 372 extend parallel to the axis of the air passage. In this embodiment, the guiding plate 363 is disposed on the inner wall of the adjusting member 36, and the guiding groove 372 is disposed on the outer wall of the connecting portion 37, so that the adjusting member 36 can be moved smoothly relative to the connecting portion 37. In other examples, the guiding structure may also be configured as a structure in which a guiding rail cooperates with a slider, other than the guiding plate 363 and the guiding groove 372.

More specifically, four groups of the connecting protrusions 362 and the connecting holes 371 are provided, and two groups of the guiding plates 363 and the guiding grooves 372 are provided. The two opposite sides of the connecting portion 37 are respectively provided with two groups of connecting protrusions 362 and connecting holes 371 and one group of guiding plates 363 and guide grooves 372. The group of guiding plates 363 and guiding grooves 372 on each side are disposed between the two groups of connecting protrusions 362 and the connecting holes 371. In this embodiment, a side of the connecting portion 37 facing the air outlet is flat. Two opposite surfaces of the connecting portion 37 are provided with two connecting holes 371 and one guiding groove 372, respectively. One guiding groove 372 on each side is located between the two connecting holes 371.

More specifically, two guiding plates 363 are latched into one guiding groove 372. The two guiding plates 363 are disposed in parallel and spaced apart from each other. The two guiding plates 363 are respectively abutted against two side walls of the guiding groove 372. The guiding groove 372 is provided with an outward-expanded guiding inlet at an opening facing the air outlet, which is convenient for aligning and mounting of the two guiding plates 363.

Optionally, the adjusting member 36 and the connecting portion 37 are provided with positioning structures which are worked in a cooperative manner. When the adjusting member 36 is moved relative to the connecting portion 37, the adjusting member 36 can be held at a plurality of positions by the positioning structure, such that the cross-sectional area of the air passage located at the deformation area can be adjusted into many different values.

Specifically, each of the positioning structures includes a positioning block group 364 and a positioning protrusion 373. One of the positioning block group 364 and the positioning protrusion 373 is disposed on the adjusting member 36 and the other thereof is disposed on the connecting portion 37. The positioning block group 364 includes a plurality of positioning blocks. The positioning protrusion 373 can be latched between any two adjacent positioning blocks. In this embodiment, the side of the connecting portion 37 facing the air outlet is flat. Two opposite arc surfaces of the connecting portion 37 are respectively provided with one positioning protrusion 373. The positioning protrusion 373 can be elastically deformed relative to the connecting portion 37. Two positioning block groups 364 are disposed on the inner wall of the adjusting member 36 and correspond to the two positioning protrusions 373. Each positioning block group 364 includes three positioning blocks. The three positioning blocks 364 may have the same size or different sizes. By moving the positioning protrusion 373 to locations between different positioning blocks, the cross-sectional area of the air passage at the position of the deformation area can be adjusted to different values.

The present disclosure also provides a hair dryer. The hair dryer includes a body and the aforementioned nozzle with which air volume can be adjusted, and the nozzle is detachably mounted on the body.

In the hair dryer of the present disclosure, by providing the air guiding member and the adjusting member 36 which work cooperatively, an air outlet area can be adjusted by one nozzle. The fine adjustment of the blower is therefore further realized, and the adjustment is simple and convenient. In this case, there is no need to provide a plurality of redundant nozzles, thereby improving the actual value of the nozzle.

Twelfth Embodiment

Figure 28:
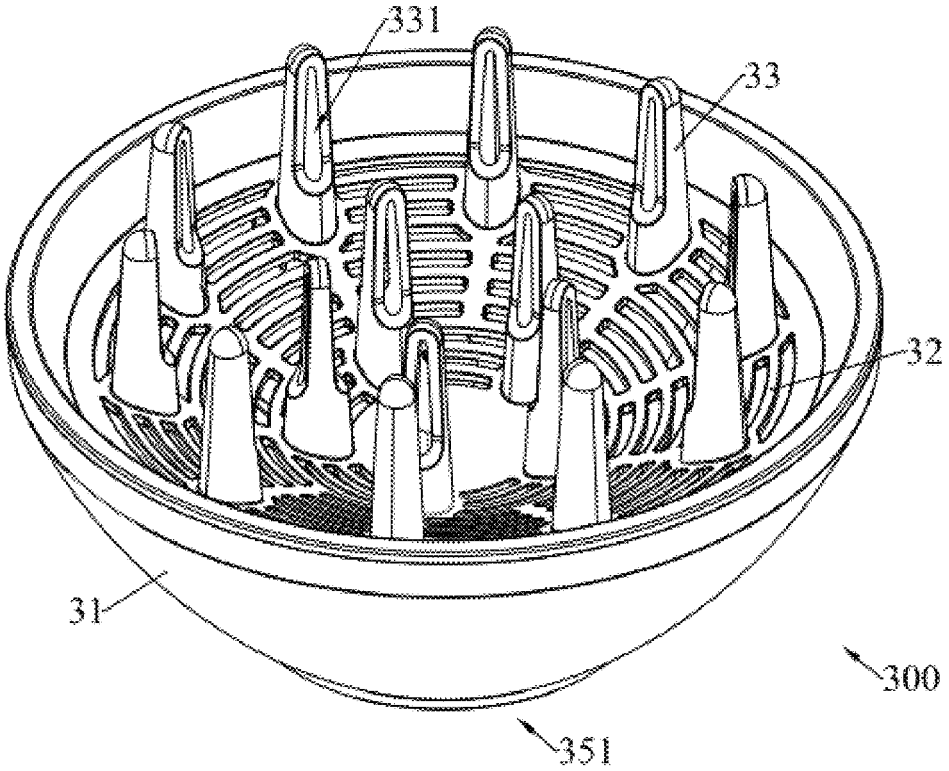
FIG. 28 is a schematic view of a nozzle according to a twelfth embodiment of the present disclosure.
Figure 29:
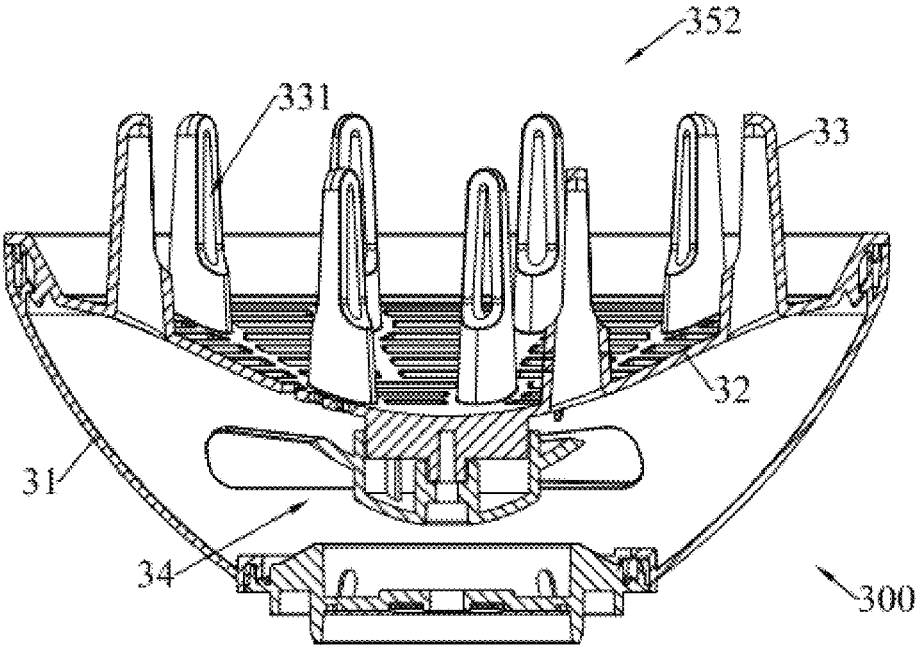
FIG. 29 is a cross-sectional view of the nozzle according to the twelfth embodiment of the present disclosure.

This embodiment provides a hair dryer. The difference of hair dryer of this embodiment over those in the aforementioned embodiments is as follows. As shown in FIGS. 28 and 29, in this embodiment, the nozzle 300 includes a main body 31. The main body 31 is provided with an inlet port and an outlet port. The outlet port includes a grille 32 and a plurality of comb teeth 33. The plurality of comb teeth 33 extend outward from the grille 32. A portion of air received by the nozzle 300 is discharge through the grille 32 in a first direction to form a longitudinal fluid. The first direction is the axial direction of the blower cylinder 100 in a state when the nozzle 300 is connected to the blower cylinder 100. At least a portion of the comb teeth 33 are provided with a plurality of air outlet ports 331 along the circumferential direction thereof. The other portion of the air is discharge through the air outlet ports 331 in a second direction (the second direction is perpendicular to the first direction) to form a transverse fluid. Compared with a solution in which each comb tooth 33 is only provided with one air outlet-port331, the nozzle 300 of this embodiment can provide more transverse fluids to disturb the longitudinal fluid, so that the fluid at the position of the outlet 352 of the nozzle is softer and is not easy to diffuse outwards, and temperature at the position of the outlet 352 of the nozzle is higher. Thus, the time required for drying hair is shortened, and the demands of consumers are met.

Illustratively, the comb teeth 33 in this embodiment are provided in groups, including a first comb tooth group and a second comb tooth group. The first comb tooth group includes five first comb teeth arranged in an annular array. The second comb tooth group includes ten second comb teeth arranged in an annular array. The ten second comb teeth of the second comb tooth group are coaxially provided around the first comb tooth group. Each of the first comb teeth is circumferentially provided with two first air outlet ports distributed along a radial direction of the grille 32. Each of the second comb teeth is provided with a second air outlet port. The nozzle 300 of this embodiment has twenty transverse airflows in total. If each first comb tooth is provided with only one first air outlet port, the nozzle 300 has fifteen transverse airflows in total. The nozzle 300 in this embodiment has five transverse airflows more than the nozzle in the prior art, such that the transverse air flows and the longitudinal air flows are disturbed more fully. In other embodiments, the number of comb tooth groups and the number of comb teeth in each comb tooth group can also be different from those mentioned above.

In this embodiment, the second comb teeth in the second comb tooth group are disposed on the outer ring, and only the second air outlet port facing the first comb tooth group is disposed on the second comb teeth, which can prevent the transverse fluid from being discharged from the outer periphery of the nozzle 300 and prevent the fluid with heat from being lost. Therefore, the fluid with heat is concentrated at a front end of the grille 32 to the maximum extent and disturbed with the longitudinal fluid, which is benefit to dry the hair quickly.

A plurality of first comb teeth are disposed on the inner ring. If the number of first comb teeth is the same as the number of second comb teeth, the first comb teeth will be arranged too close, which is inconvenient for subsequent processing of the first comb teeth. As shown in FIG. 28, the first comb tooth group and the second comb tooth group are arranged in concentric annular arrays. The second comb teeth are arranged to discharge the air toward the corresponding first comb tooth every other the second comb tooth, such that the distance between two adjacent first comb teeth is appropriate, which facilitates the processing of the first comb teeth.

A guiding fan 34 is provided on a side of the grille 32 opposite to the comb teeth. The inlet 351, the guiding fan 34, and the grille 32 are arranged in sequence along the axis of the nozzle 300. The guiding fan 34 includes blades that guide the air outwardly. The blades can enable the air entering from the inlet 351 to diffuse toward the outer periphery of the inner side of the nozzle 300, such that the air is diffused to the entire grille 32 in the circumferential direction and then is discharged from grille holes, ensuring that the nozzle 300 has a larger drying area. The nozzle 300 can dry a large amount of hair in a single time, which can effectively shorten the time required for drying hair. In other embodiments, the guiding fan 34 can also be replaced with an air director that can guide air outwardly, or the like.

In order to prevent the user's hair from being stirred into the guiding fan 34 and to ensure the personal safety of the user, the guiding fan 34 is fixed to the grille 32. Screws are screwed onto the guiding fan 34 and the grille 32 along an axis of the grille 32, so that the guiding fan 34 and the grille 32 are fixed together along the axis direction of the grille 32. The guiding fan 34 is provided with an inserting block. The grille 32 is provided with an inserting groove. The inserting block and the inserting groove extend along the axis direction of the grille 32. The inserting block is inserted into the inserting groove, so that a rotation of the guiding fan 34 relative to the grille 32 is prevented. By the cooperation of the screws, the inserting block, and the inserting groove, the guiding fan 34 is better fixed to the grille 32. In other embodiments, the inserting block can also be disposed on the grille 32 and the inserting groove is disposed on the guiding fan 34, which can also prevent the rotation of the guiding fan 34 relative to the grille 32.

In this embodiment, the inserting block and a mounting cover of the guiding fan 34 can be integrally formed, which simplifies the production of the mounting cover and improves the production efficiency of the mounting cover.

In order to increase a hole rate (which is a ratio of the total area of the grille holes to the area of the grille 32) of the grille 32, the grille 32 is provided with a plurality of groups of grille hole groups that are concentric and provided at intervals along the radial direction. Each grille hole group includes a plurality of grille holes distributed along the circumferential direction of the grille 32 at intervals. The grille holes are arc-shaped holes. In addition, by providing the grille holes as arc-shaped holes, the nozzle 300 can be made of less material, resulting in low cost and simple production to the nozzle 300.

Optionally, the inside of the first comb tooth is provided with a first hole in communication with the inlet 351. A cross section of the first comb tooth may have a shape of ellipse. The first air outlet port is a notch formed by cutting the first comb tooth along a length direction of the comb tooth. A semi-major axis of the ellipse is perpendicular to the cutting surface. Since the semi-major axis of the ellipse is perpendicular to the cutting surface, a size of the cut ellipse is reduced in a direction of the semi-major axis thereof. The shape of the ellipse after cut approaches to a circle, such that the cross section of the first comb tooth after cut tends to be circular, and an outer periphery of the first comb tooth is smoother. When the smoother periphery of the first comb tooth is in contact with the user's scalp, the user will have a very comfortable experience.

The above content is only the preferred embodiments of the present disclosure. For those of ordinary skill in the art, based on the ideas of the present disclosure, there will be changes in the specific implementation and the scope of application. The content of this specification should not be construed as a limitation on the present disclosure.

What is claimed is:

1. A hair dryer, comprising a blower cylinder and a handle, wherein the blower cylinder is provided with a blowing assembly and an electronic control printed circuit board (PCB) sleeved outside the blowing assembly therein, the electronic control PCB is electrically connected to the blowing assembly, the electronic control PCB is located outside a main air passage of the blower cylinder and is connected to a heat dissipation structure;

wherein the heat dissipation structure comprises a heat dissipation assembly in contact with a heater element of the electronic control PCB, at least a portion of the heat dissipation assembly is located in the main air passage; and wherein the heat dissipation assembly comprises a first heat dissipation sheet, one end of the first heat dissipation sheet is in contact with the heater element of the electronic control PCB, and the other end of the first heat dissipation sheet is located in an air inlet of the blower cylinder.

2. The hair dryer according to claim 1, wherein the blower cylinder has a length of less than 120 mm, and a diameter of less than 77 mm.

3. The hair dryer according to claim 1, wherein the handle has a length of less than 170 mm, and a diameter of less than 40 mm.

4. The hair dryer according to claim 1, wherein the hair dryer further comprises a heating chamber disposed downstream of the blowing assembly, the blowing assembly is provided with a blowing chamber therein, and the heating chamber and the blowing chamber forms the main air passage.

5. The hair dryer according to claim 4, wherein the heat dissipation structure comprises:

an air director connecting the blowing assembly and the heating chamber, the air director is provided with a flow guiding structure thereon, and the flow guiding structure is configured to guide a portion of airflow passing through the blowing assembly to the electronic control PCB.

6. The hair dryer according to claim 4, wherein the blower cylinder is provided with a mounting sleeve therein, the electronic control PCB is sleeved outside the mounting sleeve, the blowing assembly comprises a blower disposed in the mounting sleeve, an interior of the blower forms the blowing chamber.

7. The hair dryer according to claim 1, wherein the heat dissipation assembly comprises a second heat dissipation sheet, one end of the second heat dissipation sheet is in contact with the heater element of the electronic control PCB, and the other end of the second heat dissipation sheet extends into the main air passage downstream of the blowing assembly.

8. The hair dryer according to claim 1, wherein a thermally conductive silicone grease is provided between the heater element and the heat dissipation assembly.

9. The hair dryer according to claim 1, wherein the handle is provided with a negative ion generator therein, and a discharging end of the negative ion generator extends into the blower cylinder.

10. The hair dryer according to claim 9, wherein the blower cylinder is provided with an inner cylinder therein, the blower cylinder is provided with an ion outlet at the air-outlet-side thereof, the discharging end is located in the inner cylinder and disposed facing toward the ion outlet.

11. The hair dryer according to claim 1, wherein the handle is provided with a secondary air passage therein, and the secondary air passage is in communication with the main air passage.

* * * * *